US007172493B2

(12) United States Patent
Novak et al.

(10) Patent No.: US 7,172,493 B2
(45) Date of Patent: Feb. 6, 2007

(54) FINE FORCE ACTUATOR ASSEMBLY FOR CHEMICAL MECHANICAL POLISHING APPARATUSES

(75) Inventors: W. Thomas Novak, Hillsborough, CA (US); Douglas C. Watson, Campbell, CA (US); Pai-Hsueh Yang, Palo Alto, CA (US); Bausan Yuan, San Jose, CA (US)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 11/252,483

(22) Filed: Oct. 18, 2005

(65) Prior Publication Data

US 2006/0035564 A1 Feb. 16, 2006

Related U.S. Application Data

(63) Continuation-in-part of application No. 11/058,099, filed on Feb. 14, 2005, now abandoned, and a continuation-in-part of application No. 10/722,090, filed on Nov. 24, 2003, now Pat. No. 6,855,032.

(60) Provisional application No. 60/621,399, filed on Oct. 22, 2004.

(51) Int. Cl.
*B24B 49/00* (2006.01)

(52) U.S. Cl. ..... 451/11; 451/41; 451/288

(58) Field of Classification Search ..... 451/5, 451/9–11, 59, 41, 285–289; 438/691–693
See application file for complete search history.

(56) References Cited

U.S. PATENT DOCUMENTS 4,811,522 A 3/1989 Gill, Jr.
5,882,243 A 3/1999 Dat et al.
5,989,103 A 11/1999 Birang et al.
5,989,104 A 11/1999 Kim et al.
6,059,638 A 5/2000 Crevasse et al.
6,213,855 B1 4/2001 Natalicio
6,863,771 B2 * 3/2005 Brown ..... 156/345.14
6,935,929 B2 * 8/2005 Elledge ..... 451/41
2002/0033230 A1 3/2002 Hayashi et al.
2004/0043699 A1 * 3/2004 Chandrasekaran ..... 451/5
2004/0223283 A1 11/2004 Hsin

* cited by examiner

*Primary Examiner*—Dung Van Nguyen
(74) *Attorney, Agent, or Firm*—Steven G. Roeder; James P. Broder

(57) ABSTRACT

A polishing apparatus (10) for polishing a device (12) with a polishing pad (48) includes a pad holder (50) and an actuator assembly (432). The pad holder (50) retains the polishing pad (48). The actuator assembly (432) includes a plurality of spaced apart actuators (438F) (438S) (438T) that are coupled to the pad holder (50). The actuators (438F) (438S) (438T) cooperate to direct forces on the pad holder (50) to alter the pressure of the polishing pad (48) on the device (12). At least one of the actuators (438F) (438S) (438T) includes a first actuator subassembly (440) and a second actuator subassembly (442) that interacts with the first actuator subassembly (440) to direct a force on the pad holder (50). The second actuator subassembly (442) is coupled to the pad holder (50) and the second actuator subassembly (442) rotates with the pad holder (50) relative to the first actuator subassembly (440).

46 Claims, 12 Drawing Sheets

FINE FORCE ACTUATOR ASSEMBLY FOR CHEMICAL MECHANICAL POLISHING APPARATUSES

RELATED APPLICATION

The application is a continuation-in-part of Application Ser. No. 11/058,099 filed on Feb. 14, 2005, which is abandoned. The application is also a continuation-in-part of Ser. No. 10/722,090, filed Nov. 24, 2003, now U.S. Pat. No. 6,855,032, which issued on Feb. 15, 2005. This application also claims priority on Provisional Application Ser. No. 60/621,399 filed on Oct. 22, 2004. As far as is permitted, the contents of U.S. Pat. No. 6,855,032, application Ser. No. 11/058,099 and Provisional Application Ser. No. 60/621,399 are incorporated herein by reference.

BACKGROUND

Chemical mechanical polishing apparatuses (CMP apparatuses) are commonly used for the planarization of silicon wafers. In one type of CMP apparatus, a rotating pad is placed in contact with a rotating wafer and the pad is moved back and forth laterally relative to the rotating wafer. Additionally, a polishing slurry is forced into a gap between the wafer and the pad.

Wafers with low dielectric constants have relatively low mechanical strength and low adhesiveness. Unfortunately, existing CMP apparatuses are unable to apply relatively low pressure to the wafer. As a result thereof, the CMP apparatus can damage the wafer during the polishing process or can polish the wafer in a non uniform fashion.

SUMMARY

The present invention is directed to a precision apparatus for polishing a device with a polishing pad. In one embodiment, the polishing apparatus includes a pad holder and a force assembly. The pad holder retains the polishing pad. The force assembly includes a plurality of spaced apart actuators that are coupled to the pad holder. The actuators cooperate to direct forces on the pad holder to alter and dynamically adjust the pressure of the polishing pad on the device.

In one embodiment, at least one of the actuators includes a first actuator subassembly and a second actuator subassembly that interacts with the first actuator subassembly to direct a force on the pad holder. In this embodiment, the second actuator subassembly is coupled to the pad holder and the second actuator subassembly rotates with the pad holder relative to the first actuator subassembly. Further, at least one of the actuators can be an attraction only actuator. For example, the attraction only actuator can include a first core that is somewhat "C" shaped or somewhat "E" shaped. Alternatively, at least one of the actuators can be a voice coil type actuator.

The present invention is also directed to a method for making a device, a method for making a wafer, and a method for making a polishing apparatus.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
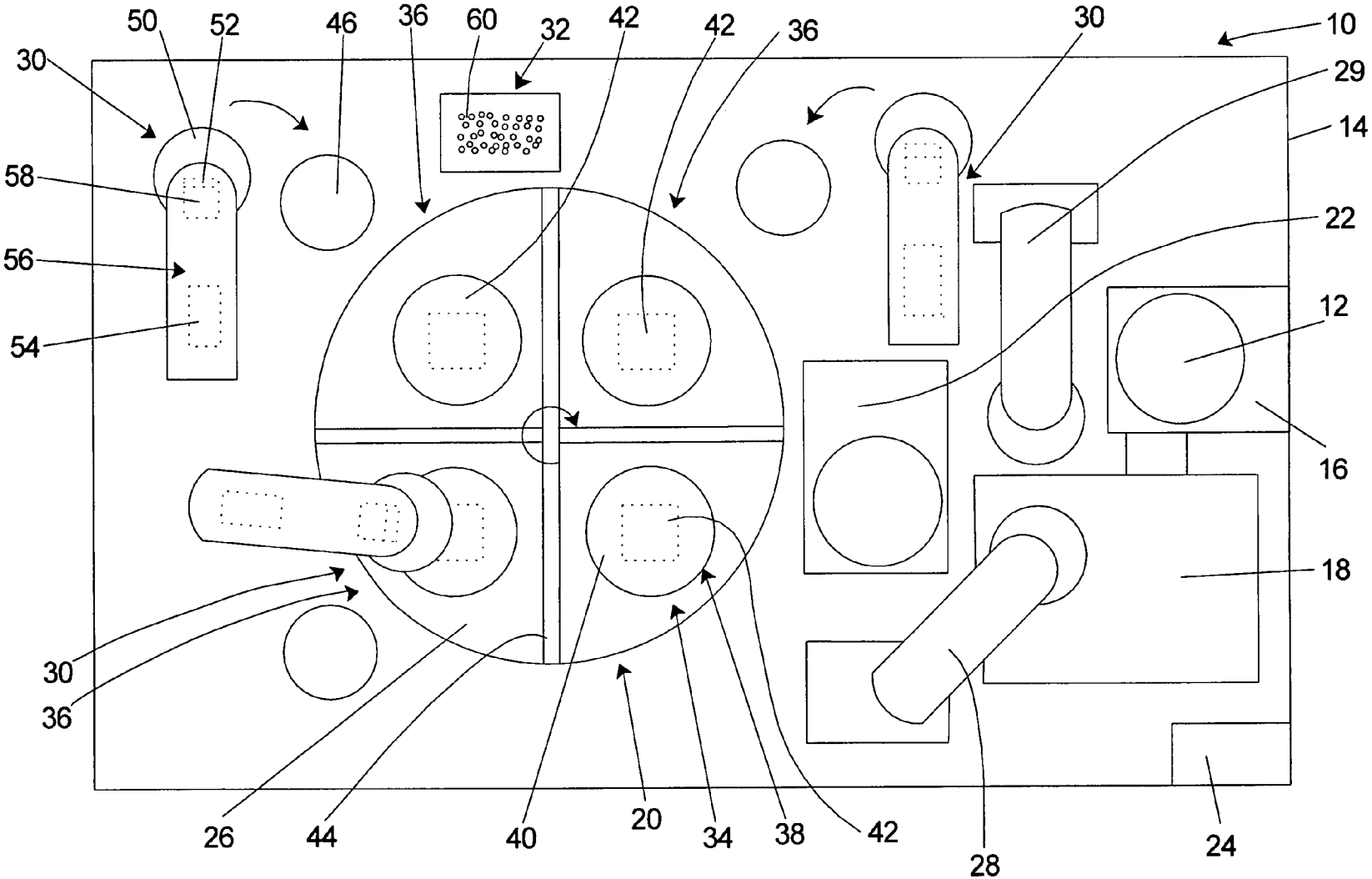
FIG. 1 is a schematic illustration of an apparatus having features of the present invention.

FIG. 1 illustrates a top plan illustration of a precision apparatus 10 having features of the present invention. For example, the apparatus 10 can be used for the preparation, cleaning, polishing, and/or planarization of a substrate 12. The design of the apparatus 10 and the type of substrate 12 can vary. In the embodiment illustrated in FIG. 1, the apparatus 10 is a Chemical Mechanical Polishing system that is used for the planarization of a semiconductor wafer 12. Alternatively, for example, the apparatus 10 can be used to clean and/or polish another type of substrate 12, such as bare silicon, glasses, a mirror, or a lens. In certain designs, the apparatus 10 applies a relatively low and uniform force on the substrate 12 during polishing.

In FIG. 1, the apparatus 10 includes a frame 14, a loading station 16, a cleaning station 18, a polishing station 20, a receiving station 22, and a control system 24. The frame 14 supports the other components of the apparatus 10.

The loading station 16 provides a holding area for storing a number of substrates 12 that have not yet been prepared for their intended purpose. For example, the substrates 12 can be unplanarized and unpolished. The substrates 12 are transferred from the loading station 16 to the receiving station 22. The substrate 12 is then transferred to the polishing station 20 where the substrate 12 is planarized and polished to meet the desired specifications. After the substrate 12 has been planarized and polished, the substrate 12 is then transferred through the receiving station 22 to the cleaning station 18. The cleaning station 18 can include a rotating brush (not shown) that gently cleans a surface of the substrate 12. After the cleaning procedure, the substrate 12 is transferred to the loading station 16 from where it can be removed from the apparatus 10 and further processed.

In the embodiment illustrated in FIG. 1, the polishing station 20 includes a polishing base 26, two transfer devices 28, 29, three polishing systems 30, and a fluid source 32. Alternatively, for example, the polishing station 20 can be designed with more than three polishing systems 30 or less than three polishing systems 30 or more than one fluid source 32.

The polishing base 26 is substantially disk shaped and is designed to be rotated in either a clockwise or counterclockwise direction about a centrally located axis. As shown in FIG. 1, the polishing base 26 can be designed to rotate in a clockwise direction about the axis to progressively and stepwise move the substrate 12 from a load/unload area 34 to each of three polishing areas 36 and then back to the load/unload area 34. The polishing base 26 can also be referred to as an index table.

In FIG. 1, the polishing base 26 includes four holder assemblies 38 that each retain and rotate one substrate 12. Each holder assembly 38 includes a vacuum chuck or gimbaled substrate holder 40 that retains one substrate 12 and a substrate rotator 42 (illustrated in phantom) that rotates the substrate holder 40 and the substrate 12 about a substrate axis of rotation during polishing. Additionally, the polishing base 26 includes a "+" shaped divider that separates the substrate holders 40.

The substrate rotator 42 can be designed to rotate the substrate 12 in the clockwise direction or the counter clockwise direction. In one embodiment, the substrate rotator 42 includes a motor that selectively rotates the substrate 12 between approximately negative 400 and 400 revolutions per minute.

In FIG. 1, each holder assembly 38 holds and rotates one substrate 12 with the surface to be polished facing upward. Alternatively, for example, the polishing station 20 could be designed to hold the substrate 12 with the surface to be polished facing downward or to hold the substrate 12 without rotating the substrate 12 during polishing.

The transfer device 29 transfers the substrate 12 to be polished from the receiving station 22 to the substrate holder 40 positioned in the load/unload area 34. Subsequently, the transfer device 28 transfers a polished substrate 12 from the substrate holder 40 positioned in the load/unload area 34 through the receiving station 22 to the cleaning station 18. The transfer devices 28 and 29 can include a robotic arm that is controlled by the control system 24.

The polishing station 20 illustrated in FIG. 1 includes three polishing systems 30, each of the polishing systems 30 being designed to polish the substrate 12 to a different set of specifications and tolerances. By using three separate polishing systems 30, the apparatus 10 is able to deliver improved planarity and step height reduction, as well as total throughput. The desired polished profile can also be changed and controlled depending upon the requirements of the apparatus 10.

The design of each polishing system 30 can be varied. In FIG. 1, each polishing system 30 includes a pad conditioner 46; a polishing pad 48 (illustrated in FIG. 3A) having a polishing surface; a pad holder 50; a pad rotator 52 (illustrated in phantom); a lateral mover 54 (illustrated in phantom); a polishing arm 56 that moves the polishing pad 48 between the pad conditioner 46 and a location above the substrate 12 on the polishing base 26; a pad force assembly 58 (illustrated in phantom in FIG. 1); and a detector (not shown) that monitors the surface flatness of the substrate 12. In this embodiment, each polishing system 30 holds the polishing pad 48 so that the polishing surface faces downward. However, the apparatus 10 could be designed so that the polishing surface of one or more of the polishing pads 48 is facing upward.

The pad conditioner 46 conditions and/or roughens the polishing surface of the polishing pad 48 so that the polishing surface has a plurality of asperities and to ensure that the polishing surface of the polishing pad 48 is uniform.

The pad rotator 52 rotates the polishing pad 48. The rotation rate can vary. In one embodiment, the pad rotator 52 includes a rotator motor (not shown) that selectively rotates the polishing pad 48 at between approximately negative 800 and 800 revolutions per minute.

In one embodiment, the difference in relative rotational movement of the pad rotator 52 and the substrate rotator 42 is designed to be relatively high, approximately between negative 800 and 400 revolutions per minute. In this embodiment, the high speed relative rotation, in combination with relatively low pressure between the polishing pad 48 and the substrate 12 helps to enable greater precision in planarizing and polishing the substrate 12. Further, the polishing pad 48 and the substrate 12 can be rotated in the same or opposite direction.

The pad lateral mover 54 selectively moves and sweeps the pad 48 back and forth laterally, in an oscillating motion relative to the substrate 12. This allows for uniform polishing across the entire surface of the substrate 12. In one embodiment, the pad lateral mover 54 moves the polishing pad 48 laterally a distance of between approximately 30 mm and 80 mm and at a rate of between approximately 1 mm/sec and 200 mm/sec. However, other rates are possible.

The pad force assembly 58 controls the force that the polishing pad 48 directly or indirectly applies against the substrate 12. In one embodiment, the pad force assembly 58 applies between approximately 0 and 10 psi between the polishing pad 48 and the substrate 12. In alternative, non-exclusive embodiments, the pad force assembly 58 controls the forces on the polishing pad 48 so that less than approximately 0.1, 0.2, 0.3, 0.5, or 1 psi is applied to the substrate 12. As a result thereof, the apparatus 10 can be used to polish substrates 12 that have relatively low mechanical strength and adhesiveness.

In certain embodiments, the pad force assembly 58 controls the forces on the polishing pad 48 to achieve relatively uniform and even polishing of the substrate 12. For example, the pad force assembly 58 can control the forces on the polishing pad 48 to maintain the pressure between the polishing pad 48 and the substrate 12 at a substantially equal level across the entire portion of the polishing pad 48 that is adjacent to the substrate 12. In one embodiment, the pad force assembly 58 maintains the pressure between the pad 48 and the substrate 12 at a substantially equal level across the entire portion of the polishing pad 48 above the substrate 12 regardless of whether the polishing pad 48 is positioned entirely above the surface of the substrate 12 or whether the polishing pad 48 extends beyond the outer edge of the substrate 12. The pad force assembly 58 is described in more detail below.

The fluid source 32 provides a pressurized polishing fluid 60 (illustrated as circles) into a gap 64 (illustrated in FIG. 3A) between the polishing pad 48 (illustrated in FIG. 3A) and the substrate 12. It should be noted that in certain embodiments, that portions or all of the pad 48 are not in direct physical contact with the substrate 12 and that a thin film of fluid 60 exists between the pad 48 and the substrate 12. The type of fluid 60 utilized can be varied according to the type of substrate 12 that is polished. In one embodiment, the fluid 60 is a slurry that includes a plurality of nanoscale abrasive particles dispersed in a liquid. For example, the slurry used for chemical mechanical polishing can include abrasive particles comprised of metal oxides such as silica, alumina, titanium oxide and cerium oxide of a particle size of between about 10 and 200 nm in an aqueous solution. Slurries for polishing metals typically require oxidizers and an aqueous solution with a low pH (0.5 to 4.0). However, when planarizing an oxide layer, an alkali based solution (KOH or NH4OH) with a pH of 10 to 11 can be used.

In another embodiment, the slurry can include non-abrasive particles and/or abrasive-free particles.

In one embodiment, the chemical solution in the slurry can create a chemical reaction at the surface of the substrate 12 which makes the surface of the substrate 12 susceptible to mechanical abrasion by the particles suspended in the slurry. For example, when polishing metals, the slurry may include an oxidizer to oxidize the metal because metal oxides polish faster compared to the pure metal. Additionally, the fluid 60 can also include a suspension agent that is made up of mostly water plus fats, oils or alcohols that serve to keep the abrasive particles in suspension throughout the slurry.

The rate of fluid flow and the pressure of the fluid 60 directed into the gap 64 can also vary. In one embodiment, the fluid 60 is directed into the gap 64 at a flow rate of between approximately 50 ml/sec and 300 ml/sec and at a pressure of between approximately 0 and 10 psi.

The control system 24 controls the operation of the components of the apparatus 10 to accurately and quickly polish the substrates 12. For example, the control system 24 can control (i) each substrate rotator 42 to control the rotation rate of each substrate 12, (ii) each pad rotator 52 to control the rotation rate of each polishing pad 48, (iii) each pad lateral mover 54 to control the lateral movement of each polishing pad 48, (iv) each pad force assembly 58 to control the force applied by each polishing pad 48, and (v) the fluid source 32 to control the fluid flow in the gap 64.

The control system 24 can include one or more conventional CPU's and data storage systems. In one embodiment, the control system 24 is capable of high volume data processing.

Figure 2:
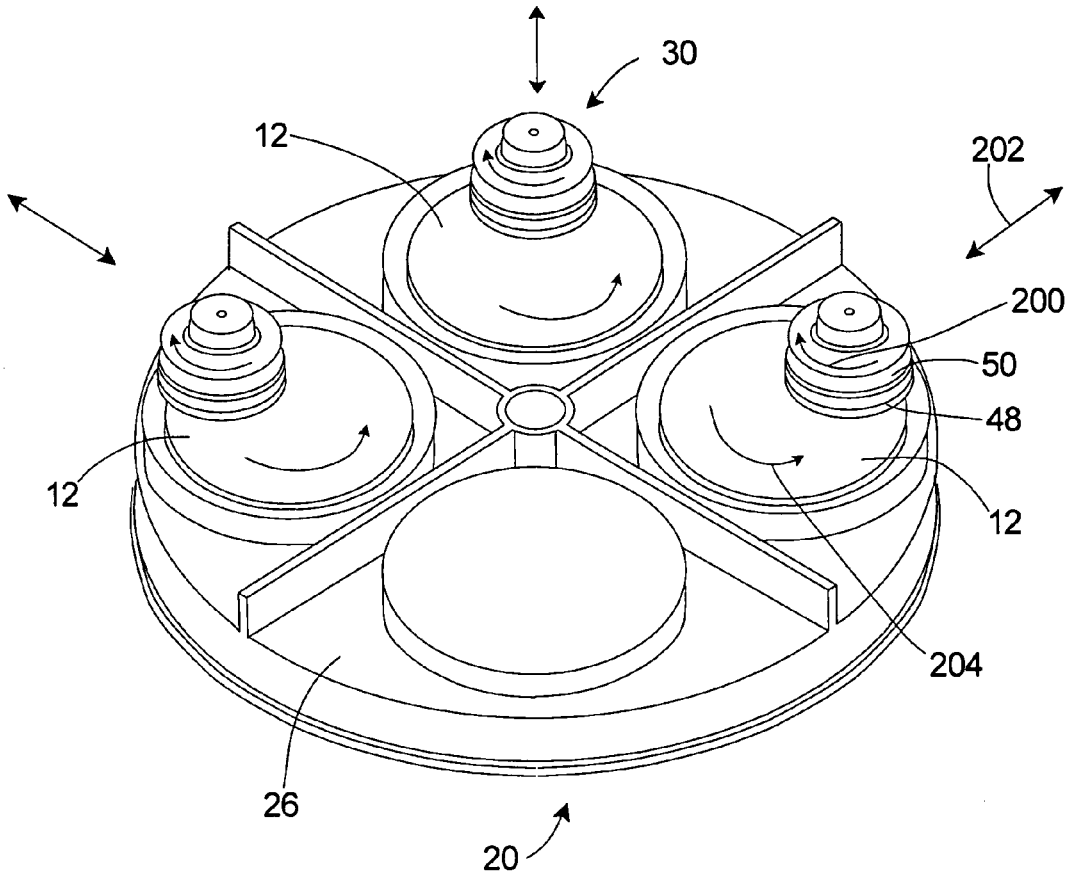
FIG. 2 is a perspective view of a portion of a polishing station of the apparatus of FIG. 1.

FIG. 2 illustrates a perspective view of a portion of the polishing station 20 of FIG. 1 and three substrates 12. More specifically, FIG. 2 illustrates the polishing base 26 and a portion of three polishing systems 30. In this embodiment, each of the pad holders 50 and polishing pads 48 are rotated as indicated by arrows 200 and moved laterally relative to the surface of the substrate 12 as indicated by arrows 202 and each substrate 12 is rotated as indicated by arrows 204.

Figure 3A:
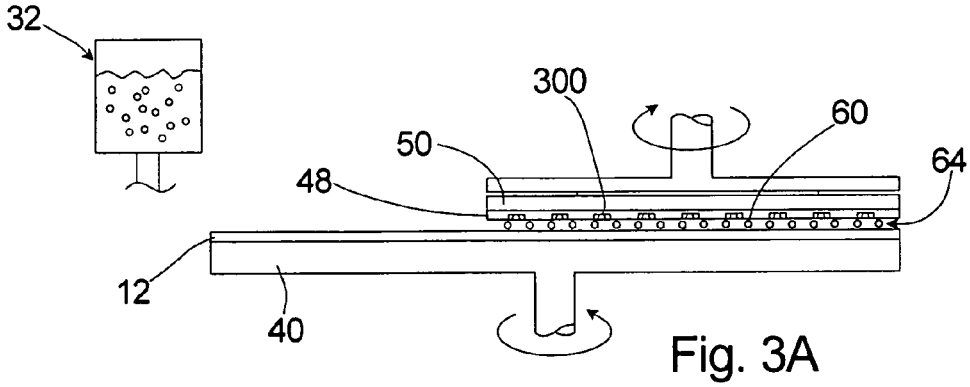
FIG. 3A is a side illustration of a substrate holder, a substrate, a pad holder, a pad, and a fluid supply having features of the present invention with the pad in a first lateral position relative to the substrate.

FIG. 3A is a side illustration of the substrate holder 40, the substrate 12, the pad holder 50, the pad 48, and the fluid source 32 with the pad 48 in a first lateral position relative to the substrate 12. FIG. 3A also illustrates the gap 64 (which is greatly exaggerated) and the fluid 60 (which is greatly exaggerated) in the gap 64. In the first lateral position, the pad 48 is completely positioned over the substrate 12.

In this embodiment, the polishing pad 48 is relatively small in diameter compared to the substrate 12. This can facilitate high speed rotation of the polishing pad 48. Additionally, the relatively small size of the polishing pad 48 results in a polishing pad 48 that is lightweight, with less pad deformity, which in turn allows for improved planarity. Alternatively, for example, the polishing pad 48 can have an outer diameter that is greater than the outer diameter of the substrate 12.

The fluid 60 supplied under pressure into the gap 64 by the fluid source 32 generates hydrostatic lift under the polishing pad 48 that reduces the load applied to the asperities of the polishing surface of the polishing pad 48.

In one embodiment, the polishing pad 48 is made of a relatively soft and wetted material such as blown polyurethane or similar substance. For example, the polishing pad 48 can be made of felt impregnated with polyurethane. The polishing surface of the polishing pad 48 is roughened to create a plurality of asperities on the polishing surface of the polishing pad 48.

In one embodiment, the polishing pad 48 is flat, annular shaped and has an outer diameter of between approximately 260 mm and 150 mm and an inner diameter of between approximately 80 mm and 40 mm. Polishing pads 48 within this range can be used to polish a wafer having a diameter of approximately 300 mm or 200 mm. Alternatively, the polishing pad 48 can be larger or smaller than the ranges provided above.

Additionally, in one embodiment, the polishing surface of the polishing pad 48 includes a plurality of grooves 300 positioned in a rectangular shaped grid pattern. Each of the grooves 300 has a groove depth and a groove width. The grooves 300 cooperate to form a plurality of spaced apart plateaus on the polishing surface of the polishing pad 48. The grooves 300 reduce pressure and hydrostatic lift in the gap 64. It should be noted that the groove shape and pattern can be changed to alter the polishing characteristics of the polishing pad 48. For example, each groove 300 can be a depth and a width on the order of between approximately 0.1 mm and 1.5 mm. Also, the grooves 300 may be in a different pattern and shape. For example, a set of radial grooves combined with a set of circular grooves also could be utilized.

Alternatively, a polishing pad 48 without grooves can be used in one or more of the polishing systems 30. Still alternatively, the polishing pad 48 could be another type of substrate.

Figure 3B:
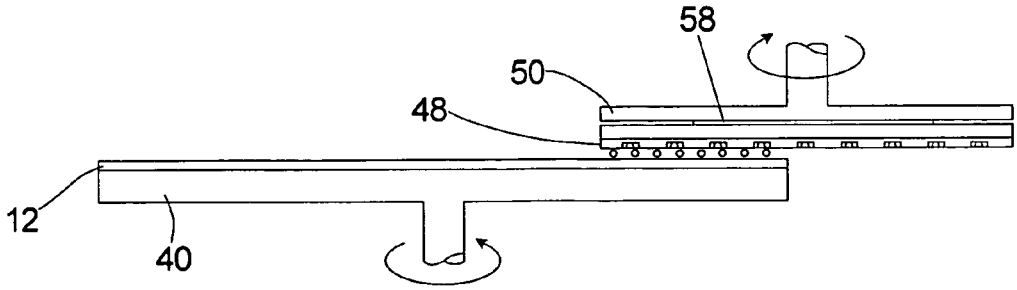
FIG. 3B is a side illustration of a substrate holder, a substrate, a pad holder, a pad, and a fluid supply with the pad in a second lateral position relative to the substrate.

FIG. 3B is a side illustration of the substrate holder 40, the substrate 12, the pad holder 50, and the pad 48, with the pad 48 in a second lateral position relative to the substrate 12. In the second lateral position, the pad 48 is only partly positioned over the substrate 12. Stated in another fashion, in the second lateral position, the pad 48 extends past an edge of the substrate 12 and only a portion of the pad 48 is positioned adjacent to the substrate 12.

As an overview, in one embodiment, the control system 24 (illustrated in FIG. 1) controls the pad force assembly 58 to maintain the force at a substantially equal and uniform level across the entire portion of the polishing pad 48 above the substrate 12 regardless of whether the polishing pad 48 is positioned entirely above the surface of the substrate 12 or whether the polishing pad 48 extends beyond the outer edge of the substrate 12. With this design, in certain embodiments, the pad 48 exerts a substantially uniform pressure on the substrate 12 regardless of the position of the pad 48 relative to the substrate 12. The pad force assembly 58 is described in greater detail below.

Figure 4A:
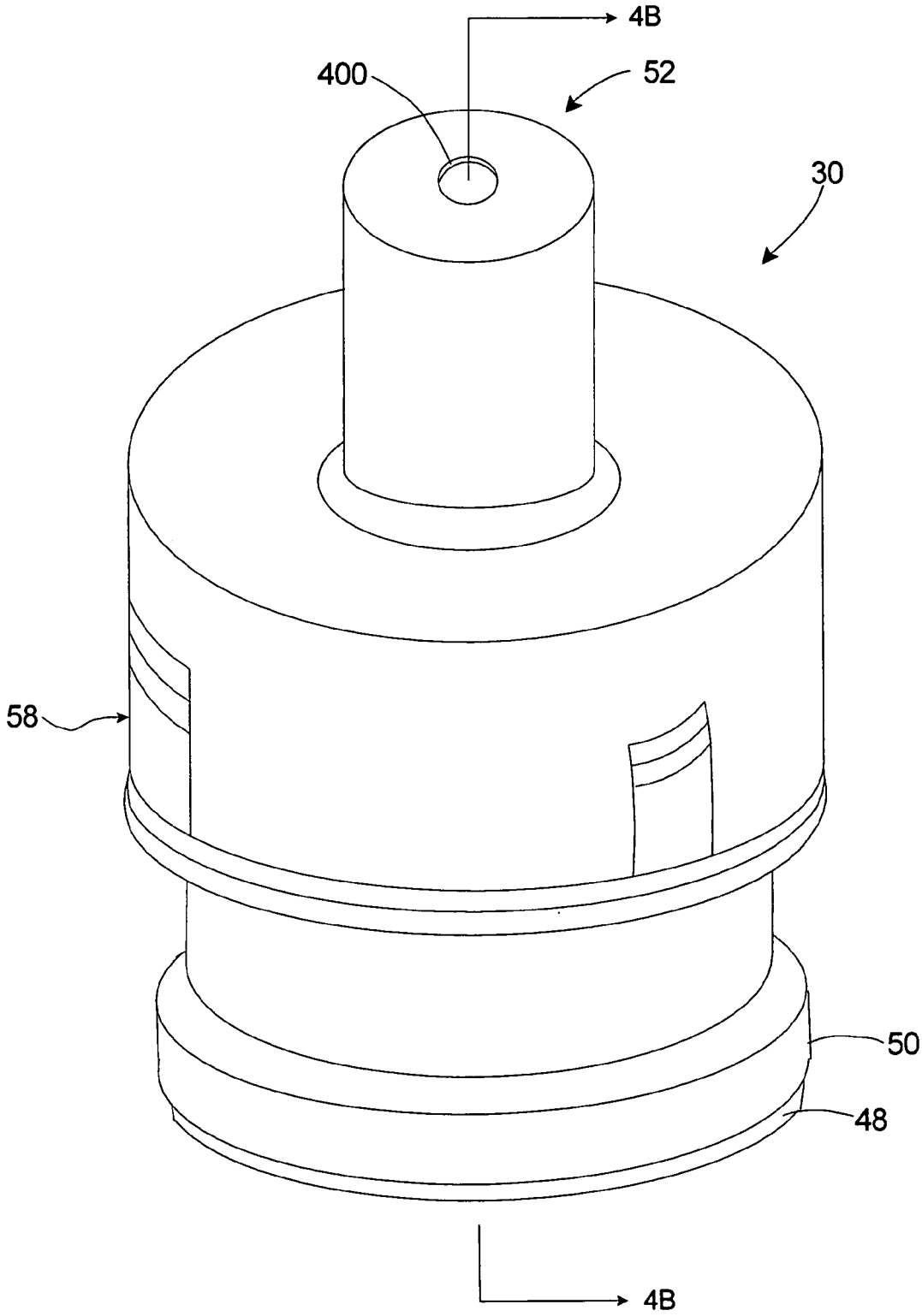
FIG. 4A is a perspective view of a polishing head assembly having features of the present invention.

FIG. 4A is a perspective view a polishing system 30 including the pad holder 50, the polishing pad 48, a portion of the pad rotator 52, a fluid conduit 400, and the pad force assembly 58 that can be used in the apparatus 10 of FIG. 1. The design of each of these components can be varied to suit the design requirements of the apparatus.

Figure 4B:
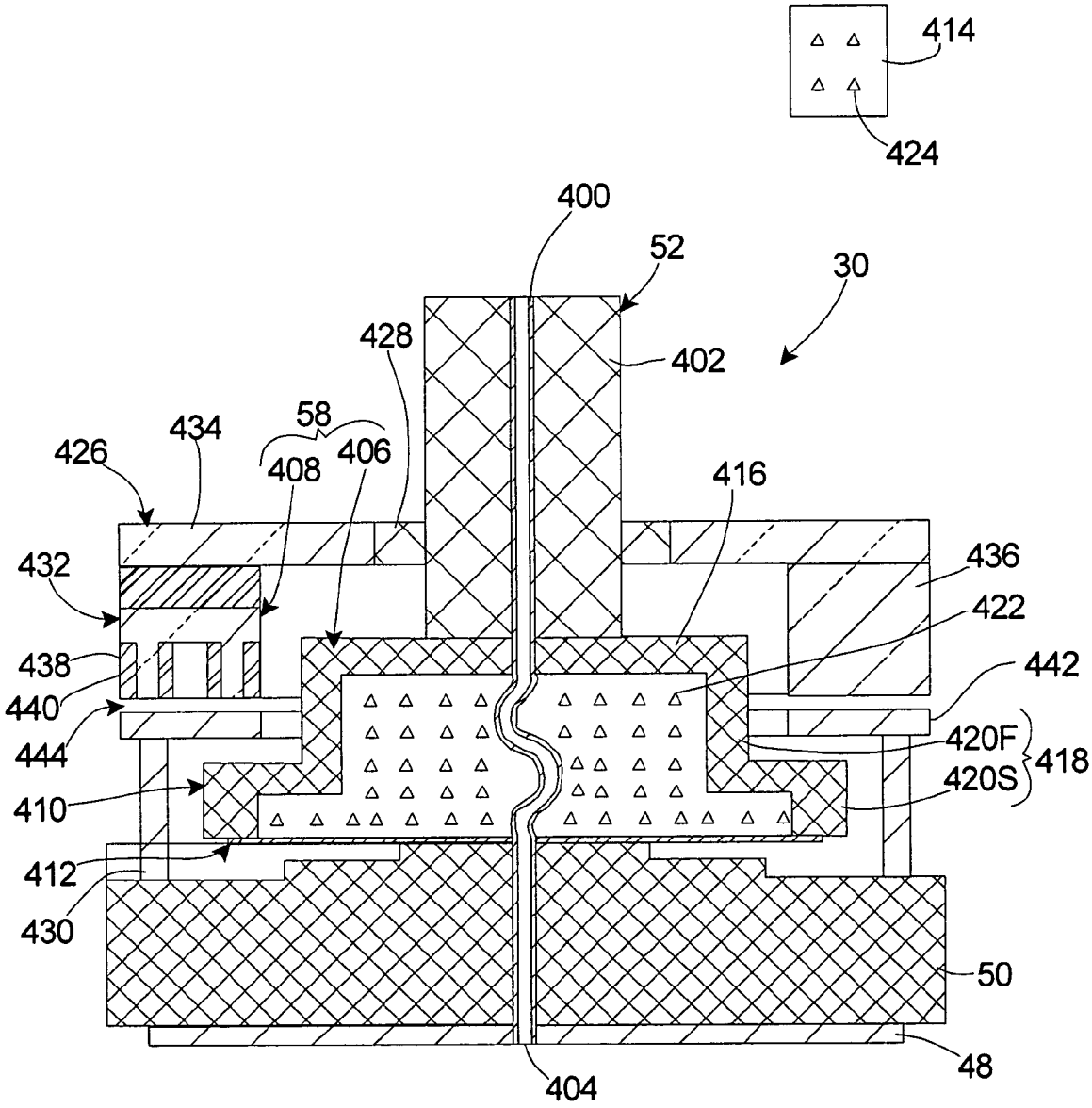
FIG. 4B is a cut-away view of the polishing head assembly of FIG. 4A.

FIG. 4B is a cut-away view of the polishing system 30 of FIG. 4A. In this embodiment, the pad holder 50 is generally disk shaped and retains the polishing pad 48. In one embodiment, the pad holder 50 uses vacuum pressure to hold the polishing pad 48 against the pad holder 50. The pad holder 50 is also referred to herein as a stage.

The pad rotator 52 includes a rotator shaft 402 that is coupled to and rotated about a central axis by the rotator motor (not shown). In FIG. 4B, the rotator shaft 402 has a substantially circular cross-section and is coupled to the pad holder 50 so that rotation of the rotator shaft 402 results in rotation of the pad holder 50.

The fluid conduit 400 is used to transfer fluid between the fluid source 32 (illustrated in FIG. 1) and the gap 64 (illustrated in FIG. 3A). In FIG. 4B, the fluid conduit 400 is a tube that extends through rotator shaft 402, the pad force assembly 58, and the pad holder 50. In one embodiment, the fluid conduit 400 includes a flexible section that allows for relative motion between the pad holder 50 and the rotator shaft 402. In FIG. 4B, the fluid conduit 400 includes a fluid outlet 404 positioned near the polishing pad 48. However, the number and location of the fluid outlets 404 can be varied. For example, the fluid conduit 400 can include a plurality of spaced apart fluid outlets 404.

The pad force assembly 58 couples and secures the pad holder 50 to the rotator shaft 402. Additionally, the pad force assembly 58 is used to control the force of the pad 48 against the substrate 12 (illustrated in FIG. 3A) and the pressure that the pad 48 applies to the substrate 12. In one embodiment, the pad force assembly 58 includes a first force adjuster 406 and a second force adjuster 408. In one embodiment, the first force adjuster 406 is used to make a relatively coarse adjustment to the forces on the pad holder 50 and the pad 48; and the second force adjuster 408 is used to make a relatively fine adjustment to the forces on the pad holder 50 and the pad 48. Alternatively, the first force adjuster 406 can be designed to make a relatively fine force adjustment to the pad 48 and the second force adjustment 408 can be designed to make a relatively coarse force adjustments to the pad 48.

In FIG. 4B, the first force adjuster 406 includes a force housing 410, a force drive ring 412, and a force fluid source 414. In this embodiment, the force housing 410 is somewhat bell shaped and includes a disk shaped top section 416 and a generally annular shaped side wall 418 that extends downward from the top section 416. In this embodiment, the wall 418 includes a first section 420F having a first inner diameter and a second section 420S having a second inner diameter that is greater than the first inner diameter. In this embodiment, the top section 416 is fixedly secured to the rotator shaft 402.

The force drive ring 412 is generally disk shaped and is secured to the bottom of the side wall 418 of the force housing 410. A bottom of the force drive ring 412 is secured to the top of the pad holder 50. In one embodiment, the force drive ring 412 is made of a material such as iron or steel. In this embodiment, the force drive ring 412 transfers rotational force from the rotator shaft 402 to the pad holder 50. The force housing 410 and the force drive ring 412 cooperate to define a force chamber 422.

The force fluid source 414 directs a fluid 424 (illustrated as triangles) into the force chamber 422 to adjust the forces on the force drive ring 412, the pad holder 50 and the pad 48. As the pressure of the pressurized fluid inside the force chamber 422 increases, the force on the force drive ring 412 increases and the pressure that the pad 48 applies to the substrate 12 increases. Conversely, as the pressure of the pressurized fluid inside the force chamber 422 decreases, the force on the force drive ring 412 decreases and the pressure that the pad 48 applies to the substrate 12 decreases.

The type of fluid 424 utilized can be varied. In one embodiment, the fluid 424 is air. Alternatively, for example, the fluid 424 can be another type of gas.

As a result of this structure, the rotational movement of the rotator shaft 402 results in rotational movement of the force housing 410, the force drive ring 412, the pad holder 50, and the polishing pad 48.

The design of the second force adjuster 408 can be varied. In FIG. 4B, the second force adjuster 408 includes a first housing 426, a bearing assembly 428, a second housing 430, and an actuator assembly 432. The design of each of these components can be varied. In FIG. 4B, the first housing 426 includes a generally flat ring shaped first section 434 and an annular ring shaped second section 436 that extends downward from the first section 434.

The bearing assembly 428 secures the first section 434 of the first housing 426 to the rotator shaft 402 and allows the rotator shaft 402 to rotate relative to the first housing 426. In one embodiment, the bearing assembly 428 includes a rolling type bearing. Additionally, another structure or frame (not shown) can be used to secure the first housing 426 and inhibit the first housing 426 from rotating concurrently with the rotator shaft 402.

The second housing 430 is generally annular tube shaped and includes a bottom end that is fixedly secured to the top of the pad holder 50. In this embodiment, the second housing 430 rotates concurrently with the pad holder 50, the rotator shaft 402 and the pad 48. Further, the second housing 430 rotates relative to the stationary first housing 426.

The actuator assembly 432 defines one or more actuators 438 that cooperate to move the second housing 430, the pad holder 50 and the pad 48 relative to the first housing 426, the rotator shaft 402, and the substrate 12. For example, in one embodiment, the actuator assembly 432 includes a plurality of attraction only type actuators 438. In FIG. 4B, the actuator assembly 432 includes a plurality of spaced apart first actuator subassemblies 440 (only one is illustrated in FIG. 4B) that are secured to the first housing 426 and a single second actuator subassembly 442 that is secured to the second housing 430 and rotates with the second housing 430. The second actuator subassembly 442 is spaced apart a component gap 444 away from each first actuator subassembly 440. In one embodiment, during normal operation of the actuator assembly 432, the component gap 444 is in the range of between approximately 0.5 mm and 2 mm.

It should be noted that at any given time, the component gap 444 for each of the actuators 438 is different. Further, during operation of the apparatus 10, the component gap 444 for each of the actuators 438 usually increases as the polishing pad 48 (illustrated in FIG. 3A) wears.

Figure 4C:
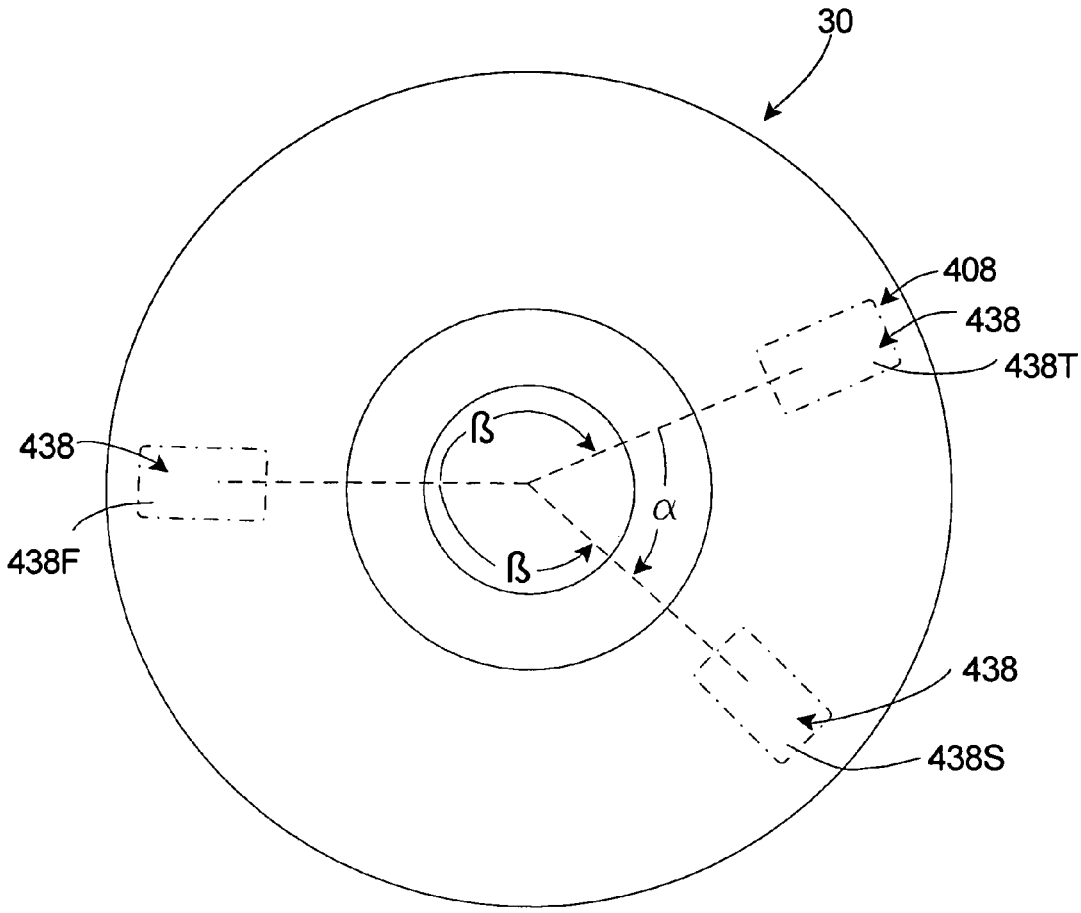
FIG. 4C is a top plan view of the polishing head assembly of FIG. 4A.

FIG. 4C illustrates a top view of a portion of the polishing system 30 of FIG. 4A. FIG. 4C illustrates that the second force adjuster 408 includes three actuators 438 (illustrated in phantom), including a first actuator 438F, a second actuator 438S, and a third actuator 438T. In one embodiment, the actuators 438F, 438S, 438T are not spaced apart evenly. In this embodiment, the second and third actuators 438S, 438T are spaced closer together and the second and third actuators 438S, 438T are equal distances from the first actuator 438F. As a non-exclusive example, the center of the first actuator 438F is at an angle β of between approximately 120 and 150 degrees from the center of the second and third actuators 438S, 438T, and the center of the second actuator 438S is at an angle α of between approximately 60 and 120 degrees from the center of the third actuator 438T.

Figure 5A:
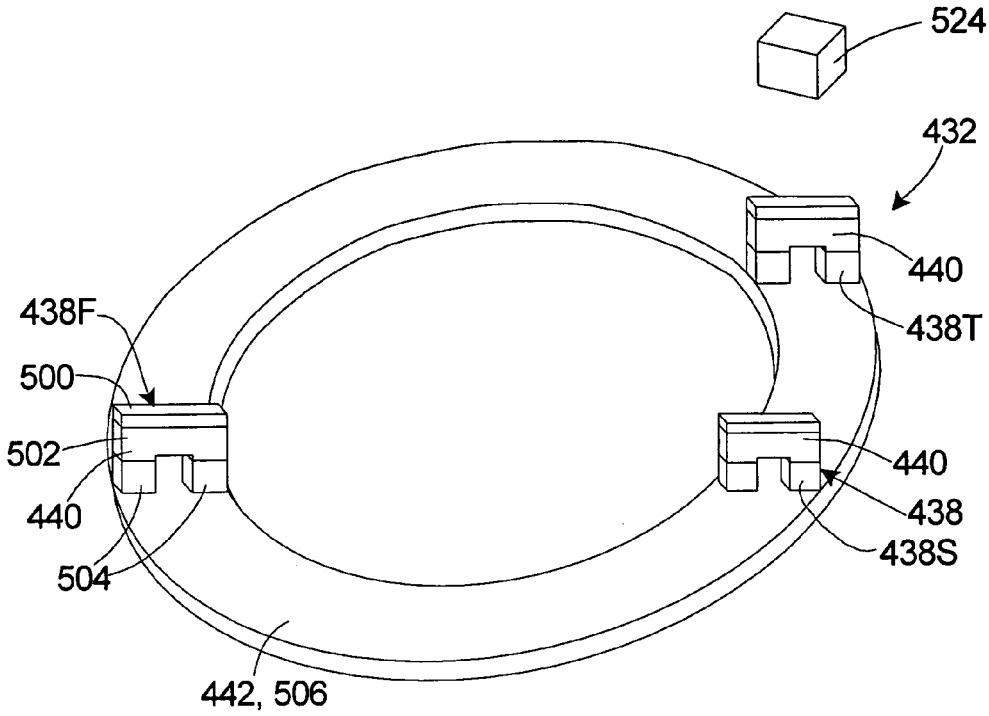
FIG. 5A is a perspective view of an actuator assembly having features of the present invention.

FIG. 5A illustrates a perspective view of one embodiment of the actuator assembly 432 including the control system 524, three spaced apart first actuator subassemblies 440 and one second actuator subassembly 442 that is spaced apart from the first actuator subassemblies 440 and from the three spaced apart actuators 438F, 438S, 438T. Alternatively, for example, the actuator assembly 432 can include more than three or less than three first actuator subassemblies 440. Each of the first actuator subassemblies 440 are spaced apart a component gap $g_1$, $g_2$, $g_3$ from the second actuator subassembly 442.

In this embodiment, each of the first actuator subassemblies 440 includes a sensor 500, a first core 502 and a pair of spaced apart conductors 504. Further, the second actuator subassembly 442 is generally flat annular ring shaped and defines a second core 506.

In this embodiment, the control system 524 directs current to the conductors 504 of each first actuator subassembly 440 to attract the second core 506 towards the first core 502.

The sensor 500 can be a load cell, e.g. a strain gauge, or another type of sensor that measures the force that acts upon the sensor 500. Because the sensor 500 secures the first actuator subassembly 440 to the first housing 426 (illustrated in FIG. 4B), each sensor 500 measures the force generated by the attraction between the actuator subassemblies 440, 442.

Additionally, the actuator assembly 432 can include a gap sensor (not shown) e.g. a capacitance sensor, that measures the component gap $g_1$ $g_2$ $g_3$ between each first actuator subassembly 440 and the second actuator subassembly 442. However, in certain designs, as discussed below, the gap sensor is not utilized.

Each first actuator subassembly 440 and the second actuator subassembly 442 cooperate to form an actuator 438. Each actuator 438, in this embodiment, is an electromagnetic, attraction only actuator. In one embodiment, the first core 502 is a C-shaped core ("C core") and the second core 506 is a ring-shaped core. The second core 506 is substantially ring-shaped and rotates with the pad holder 50 (illustrated in FIG. 4B). As the ring-shaped second core 506 rotates, a portion of the second core 506 will be positioned substantially directly beneath each of the first cores 502 at any point in time. The portion of the ring-shaped second core 506 that interacts with the first core 502 at any point in time is substantially I-shaped. As the second core 506 continues to rotate, the particular portion of the second core 506 that is positioned substantially directly beneath each of the first cores 502 will change, but at any point in time there will always be some portion of the second core 506 that will be positioned so as to interact with each of the first cores 502.

The first cores 502 and the second core 506 are each made of a rigid, magnetic material such as iron, silicon steel or Ni—Fe steel. The conductors 504 are made of an electrically conductive material.

For the first actuator 438 F, a first current $I_1$(not shown) directed through the conductor(s) 504 generates an electromagnetic field that attracts the second core 506 towards the first core 502. This results in an attractive first force $F_1$ across the first component gap $g_1$. Similarly, for the second actuator 438S, a second current $I_2$ directed through the conductor(s) 504 generates an electromagnetic field that attracts the second core 506 towards the first core 502. This results in an attractive second force $F_2$ across the second gap $g_2$. Furthermore, for the third actuator 438T, a third current $I_3$ directed through the conductor(s) 504 generates an electromagnetic field that attracts the second core 506 towards the first core 502. This results in an attractive third force $F_3$ across the gap $g_3$. The amount of current determines the amount of attraction. With this design, the first actuator 438F urges the pad 48 with a controlled first force $F_1$, the second actuator 438S urges the pad 48 with a controlled second force $F_2$, and the third actuator 438T urges the pad 48 with a controlled third force $F_3$.

With this design, in certain embodiments, the actuator assembly 432 tilts and pivots the second actuator subassembly 442, the pad holder (not shown in FIG. 5A) and the pad (not shown in FIG. 5A) without distorting and bending the pad holder and the pad. Further, the second actuator subassembly 442 rotates with the pad holder and the pad relative to the non-rotating first actuator subassembly 440.

Additionally or alternatively, the actuators 438F, 438S, 438T can be controlled to direct forces on the pad holder and the pad so that the force applied by the pad at the edge of the substrate may be reduced without active tilting of the pad to inhibit over-polishing at the edge of the substrate. Stated in another fashion, with this design, the actuators 438F, 438S, 438T can dynamically control the force applied at various positions of the pad to inhibit over-polishing at the edge, to inhibit tilting of the pad when only a portion of the pad is adjacent to the device, and/or to achieve substantially uniform polishing of the substrate.

Figure 5B:
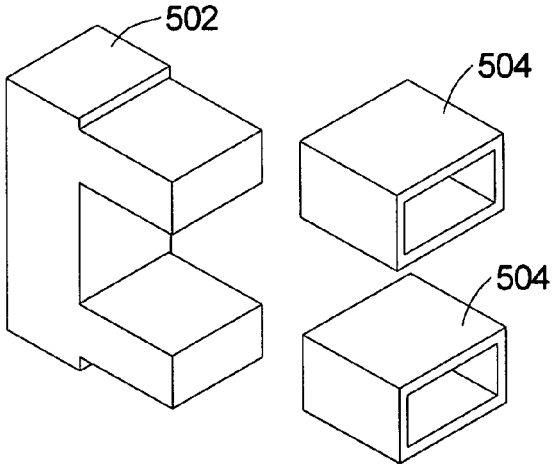
FIG. 5B is a side illustration of a portion of the actuator assembly of FIG. 5A.

FIG. 5B is an exploded perspective view of one embodiment of the first core 502 and conductors 504. In this embodiment, the first core 502 is somewhat "C" shaped. One tubular shaped conductor 504 is positioned around each end bar of the C shaped core 502. The combination of the C shaped first core 502 and the conductors 504 is sometimes referred to herein as an electromagnet.

Figure 5C:
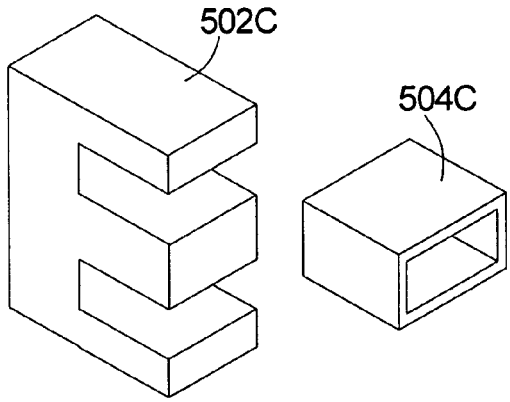
FIG. 5C is a side illustration of another embodiment of a portion of an actuator assembly that can be used in the polishing head assembly of FIG. 4A.

FIG. 5C is a perspective view of another embodiment of the first core 502C and the conductor 504C. In this embodiment, the first core 502C is E-shaped. The conductor 504 is positioned around the center bar of the E shaped first core 502C. It should be noted that other types or configurations of the actuators can be utilized.

The electromagnet actuators 438 illustrated in FIGS. 5A–5C are variable reluctance actuators and the reluctance varies with the size of the component gap 444 (illustrated in FIG. 4B), which also varies the flux and the force applied to the second core 502. The electromagnet actuators 438 can provide large force with relatively small current.

The control system 524 (i) determines the amount of current that should be directed to the conductors 504 of the first actuator subassemblies 440 and the amount of pressure in force chamber 422, (ii) controls the force fluid source 414 to direct fluid 424 into the force chamber 422, and (iii) directs current to the conductors 504 of the first actuator subassemblies 440 to achieve the desired forces applied to the pad 48 (illustrated in FIG. 3A). Stated another way, the control system 24 controls the fluid 424 to the force chamber 422 and the current level for each conductor 504 to achieve the desired resultant forces on the pad 48.

In one embodiment, the control system 524 independently directs current to each of the conductors 504 of the second force adjuster 408 at a plurality of discrete time steps t, namely $t_1$, $t_2$, $t_3$, $t_4$. . . $t_X$. At each time step, the sensor 500 also measures the force that is generated by each of the actuators 438F, 438S, 438T. The time interval that separates each time step t can be varied. In alternative examples, the time interval between time steps t is approximately 0.5, 1, 1.5, 2, 2.5 or 3 milliseconds. However, the time interval can be larger or smaller than these values. The term time interval is also referred to herein as sampling rate.

Figure 6:
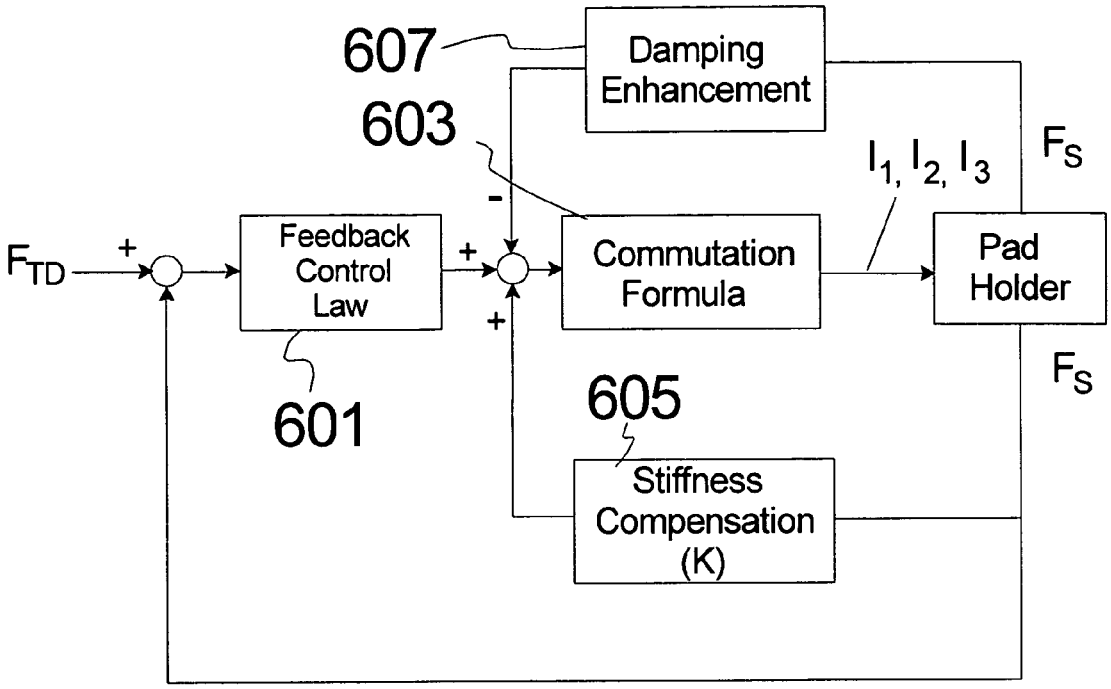
FIG. 6 is a graph that illustrates the functions of the control system.

FIG. 6 is a schematic that illustrates the functions of the control system 524. Initially, at each time step t, the control system determines a total desired force $F_{TD}$ of the pad against the substrate based on the desired polishing of the substrate. A first mover force $F_{M1}$ applied by the first force adjuster is subtracted from the total desired force $F_{TD}$ to determine (i) the amount the first force $F_1$ to be applied by the first actuator 438F, (ii) the amount the second force $F_2$ to be applied by the second actuator 438S, and (iii) the amount the third force $F_3$ to be applied by the third actuator 438T. The control law 601 prescribes the corrective action for the signal. The feedback control law may be in the form of a PI (proportional integral) controller, proportional gain controller or a lead-lag filter, or other commonly known law in the art of control, for example.

Each actuator 438F, 438S, 438T requires some kind of commutation to globally compensate for the non linearity between the input current and component gap to the force output. The control system uses a commutation formula 603 to determine the amount of current that is to be individually directed to each of the conductors 504 of the second force adjuster to achieve the forces $F_1$, $F_2$, $F_3$ at each actuator 438F, 438S, 438T at each time step t. Stated another way, the control system calculates a first current $I_1$ needed at the first actuator 438F to achieve the desired $F_1$ at the first actuator 438F, a second current $I_2$ needed at the second actuator 428S to achieve the desired $F_2$ at the second actuator 438S, and a third current $I_3$ needed at the third actuator 428T to achieve the desired $F_3$ at the third actuator 438T. The currents $I_1$ $I_2$ $I_3$ are directed to the actuators 438F, 438S, 438T and the actuators 438F, 438S, 438T impart forces $F_1$, $F_2$, $F_3$ on the pad at each time step t.

In one embodiment, the control system 524 independently directs current $I_1$ $I_2$ $I_3$ to each of the conductors 504 of the second force adjuster 408 at each time step t so that the forces $F_1$, $F_2$, $F_3$ generated by each of the actuators 438F, 438S, 438T is approximately the same. In alternative, non-exclusive embodiments, the control system 24 directs current to the conductors 504 so that the forces $F_1$, $F_2$, $F_3$ generated by each of the actuators 438F, 438S, 438T is within at least approximately 0.1, 0.2, 0.5, 1, 2, 5, 10, 20, or 100 Newtons. However, the control system 24 can direct current to the conductors 504 so that the forces $F_1$, $F_2$, $F_3$ generated by each of the actuators 438F, 438S, 438T is greater than or lesser than the amounts described above.

Stated another way, in alternative non-exclusive embodiments, the control system 24 directs current to the conductors 504 so that the forces $F_1$, $F_2$, $F_3$ generated by each of the actuators 438F, 438S, 438T are within at least approximately 1, 2, 5, 10, 20, 40, or 50 percent. However, the control system 24 can direct current to the conductors 504 so that the forces $F_1$, $F_2$, $F_3$ generated by each of the actuators 438F, 438S, 438T are within percentages that are greater than or lesser than the percentages described above.

Alternatively, the control system 24 can direct current to the conductors 504 so that the force of the pad 48 against the substrate 12 is substantially uniform across the entire portion of the pad 48 that is against the substrate 12. In alternative, non-exclusive embodiments, for example, the control system 24 can direct current to the conductors 504 so that difference in force of the pad 48 that is adjacent the substrate 12 at any and every two spaced apart locations is within at least approximately 0.05, 0.075, 0.1, 0.15, 0.2, 0.5 or 1 Newtons. However, the control system 24 can direct current to the conductors 504 so that difference in force of the pad 48 against the substrate 12 at any and every two spaced apart locations is greater than or lesser than the amounts described above.

Stated another way, in alternative, non-exclusive embodiments, the control system 24 can direct current to the conductors 504 so that difference in force of the pad 48 adjacent the substrate 12 at any and every two spaced apart locations is within at least approximately 0.5, 1, 2, 5, 10 or 20 percent. However, the control system 24 can direct current to the conductors 504 so that difference in force of the pad 48 adjacent the substrate 12 at any and every two spaced apart locations is greater than or lesser than the percentages described above.

As provided herein, the actual output force $F_1$, $F_2$, $F_3$ generated by one of the actuators 438F, 438S, 438T can be expressed as follows:

$$F=k(I^2)/(g^2) \qquad \text{equation 1}$$

where F is in Newtons; k is an electromagnetic constant which is dependent upon the geometries of the first core and the second core, and the number of coil turns in the conductor(s); I is current, measured in amperes that is directed to the conductor(s); and g is the gap distance, measured in meters.

The actual value of k is not exactly known because they depend upon the geometries, shape and alignment of the first core and the second core. In one embodiment, $k=1/2N^2 \mu_o wd$; where N=the number of coil turns in the conductor(s); $\mu_o$=a physical constant of about $1.26\times10^{-6}$H/m; w=the half width of the center of the first core, in meters; and d=the depth of the center of the first core, in meters. In one embodiment, k is equal to $7.73\times10^{-6}$ kg $m^3/s^2A^2$;

Equation 1 can be rewritten as follows:

$$l = g \times \sqrt{(F/k)} \qquad \text{equation 2}$$

$$g = l \times \sqrt{(k/F)} \qquad \text{equation 3}$$

However, in some embodiments, it is very difficult to accurately measure the component gap $g_1$ $g_2$ $g_3$ at each of the actuators 438F, 438S, 438T.

In one embodiment, when the measured value of the component gap is not available and when the component gap $g_1$ $g_2$ $g_3$ does not deviate from an operational value g', then a simplified commutation may be used. In one embodiment, the operational value g' is within with a range of between approximately 0.5 mm and 1.5 mm. However, the range may be larger or smaller.

In this example, because g' and k are constant, they can be merged to the control gain and then equation 2 can be simplified as follows:

$$I=\sqrt{F} \qquad \text{equation 4}$$

In this embodiment, at each time step t, the control system (i) takes the square root of the $F_1$ to determine the current $I_1$ that should be directed to the first actuator 438F, (ii) takes the square root of the $F_2$ to determine the current $I_2$ that should be directed to the second actuator 438S, and (iii)

takes the square root of the $F_3$ to determine the current $I_3$ that should be directed to the third actuator 438T.

In an alternative embodiment, for a system without component gap measurement but with large deviation of the component gap $g_1$ $g_2$ $g_3$, a calculated component gap $g_1$ $g_2$ $g_3$ can be calculated by the control system using information from one or more previous samples. For example, equation 3 from above can be rewritten as following:

$$g(t-1) = l(t-1) \times \sqrt{(k/F(t-1))} \quad \text{equation 5}$$

In this embodiment, F is the actual force $F_1$, $F_2$, $F_3$ applied by the particular actuator 438F, 438S, 438T at a previous time step t. The actual force $F_1$, $F_2$, $F_3$ applied by the particular actuator 438F, 438S, 438T can be measured by the sensor 500 of each actuator 438F, 438S, 438T.

Figure 7:
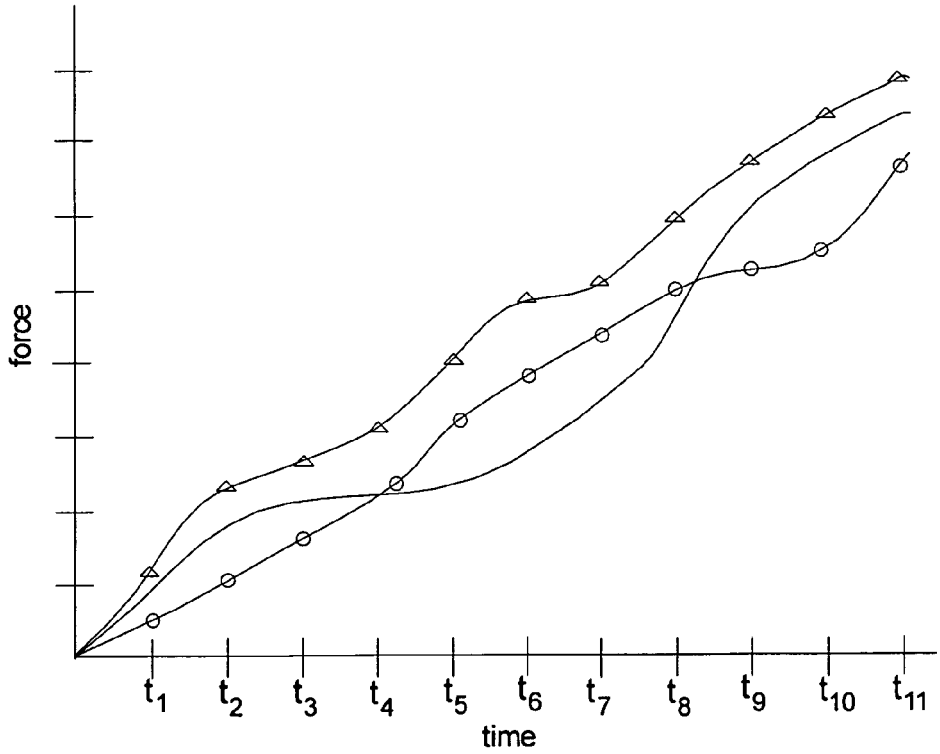
FIG. 7 is a graph that illustrates the measured forces at a plurality of time steps.

FIG. 7 is a graph that illustrates the measured forces $F_1$ (solid line), $F_2$ (solid line with triangles), and $F_3$ (solid line with circles) at a plurality of time steps t. This graph is useful to understand the subsequent versions of the invention described below.

In one embodiment, if the control-sampling rate (length of time interval) is much faster than the rate at which the component gap $g_1$ $g_2$ $g_3$ changes, then the component gap $g_1$ $g_2$ $g_3$ can be estimated by using only one earlier sample data.

$$g''(t) = g(t-1) = l(t-1) \times \sqrt{(k/F(t-1))} \quad \text{equation 6}$$

Referring to FIG. 7, in this embodiment, (i) the value of $F_1$ at the immediately previous time step t-1 is used to calculate the gap $g_1$ and subsequently the current $I_1$ that should be directed to the first actuator 438F at a particular time step t, (ii) the value of $F_2$ at the immediately previous time step t-1 is used to calculate the gap $g_2$ and subsequently the current $I_2$ that should be directed to the second actuator 438S at a particular time step t, (iii) the value of $F_3$ at the immediately previous time step t-1 is used to calculate the gap $9_3$ and subsequently the current $I_3$ that should be directed to the third actuator 438T at the next time step t.

As an example, in this embodiment, at time step $t_5$, (i) the sensor 500 measures the $F_1$ applied by the first actuator 438F, (ii) the sensor 500 measures the $F_2$ applied by the second actuator 438S, and (iii) the sensor 500 measures the $F_3$ applied by the third actuator 438T. Subsequently, during the time interval between time step $t_5$ and $t_6$, the control system (i) uses the value of $F_1$ to determine the approximate gap $g_1$ and the current $I_1$ that should be directed to the first actuator 438F at time step $t_6$, (ii) uses the value of $F_2$ to determine the approximate gap $g_2$ and the current $I_2$ that should be directed to the second actuator 438S at time step $t_6$, and (iii) uses the value of $F_3$ to determine the approximate gap $g_2$ and the current $I_3$ that should be directed to the third actuator 438T at time step $t_6$. This same process can be used in subsequent time steps t to determine the appropriate for currents $I_1$ $I_2$ $I_3$.

However, in an alternative embodiment, if the control-sampling rate (length of time interval) is much slower than the rate at which the component gap $g_1$ $g_2$ $g_3$ changes, then the component gap $g_1$ $g_2$ $g_3$ can be estimated by using data from at least two earlier samples.

$$\hat{g}(t) = \sum_{j=1}^{N} \alpha j(t) g(t-j) \quad \text{equation 7}$$

The parameters αj(t) can be fixed numbers or updated online as follows:

$$\alpha j(t+1) = \alpha j(t) + \Delta\alpha j(t) \quad \text{equation 8}$$

$$\Delta\alpha j(t) = \lambda g(t-j)(g(t) - \hat{g}(t)) \quad \text{equation 9}$$

The number of earlier samples utilized will vary according to the rate at which the component gap $g_1$ $g_2$ $g_3$ changes. Generally speaking, more control samples are used if the component gap $g_1$ $g_2$ $g_3$ rapidly changes than when the component gap $g_1$ $g_2$ $g_3$ does not change as rapidly. In alternative examples, the control system can utilize 2, 3, 4, 5, 6, 8, or 10 previous control samples.

For example, in one embodiment, the control system utilizes 4 previous control steps. Referring to FIG. 7, in this embodiment, (i) the value of $F_1$ at the immediately previous four time steps t-1 through t-4 are used to estimate the $g_1$ and subsequently calculate the current $I_1$ that should be directed to the first actuator 438F at a particular time step t, (ii) the value of $F_2$ at the immediately previous four time steps t-1 through t-4 are used to estimate $g_2$ and subsequently calculate the current $I_2$ that should be directed to the second actuator 438S at a particular time step t, (i) the value of $F_3$ at the immediately previous four time steps t-1 through t-4 are used to estimate $9_3$ and subsequently calculate the current $I_3$ that should be directed to the third actuator 438T at the next time step t.

As an example, in this embodiment, at time step $t_8$, (i) the sensor 500 measures the $F_1$ applied by the first actuator 438F at $t_4$–$t_7$, (ii) the sensor 500 measures the $F_2$ applied by the second actuator 438S at $t_4$–$t_7$, and (iii) the sensor 500 measures the $F_3$ applied by the third actuator 438T at $t_4$–$t_7$. Subsequently, during the time interval between time step $t_7$ and $t_8$, the control system (i) uses the values of $F_1$ at $t_4$–$t_7$ to determine the current $I_1$ that should be directed to the first actuator 438F at time step $t_8$, (ii) uses the values of $F_1$ to determine the current $I_2$ that should be directed to the second actuator 438S at time step $t_8$, and (iii) uses the values of $F_3$ at $t_4$–$t_7$ to determine the current $I_3$ that should be directed to the third actuator 438T at time step $t_8$. This same process can be used in subsequent time steps t to determine the appropriate for currents $I_1I_2I_3$.

It should be noted that in this embodiment, the slope of measured forces $F_1$ (solid line), $F_2$ (solid line with triangles), and $F_3$ (solid line with circles) can be taken into consideration when calculating the respective gap $g_1$ $g_2$ $g_3$.

In one embodiment, as illustrated in FIG. 6, the control system can include a stiffness compensator (K) 605 that provides stiffness compensation for the system. More specifically, as provided herein, the mechanical structure, e.g. the first housing 426 and the second housing 430, of the polishing system 30 and the pad 48 usually have finite stiffness. This stiffness contributes to resonance of the polishing system 30. When the resonance frequency is within the desired bandwidth of the actuators 438, the system 30 may have an oscillation problem, leading to lower bandwidth and poorer performance of the polishing system. In this embodiment, the control system adjusts the current to the actuators to create a force that compensates for the stiffness of the system.

Additionally, as illustrated in FIG. 6, the control system can include a damping enhancement (C) 607 that damps out oscillations of the system. The damping enhancement can be used to estimate an artificial force that should be applied by the actuators to dampen oscillations. Stated another way, with this design, the control system adjusts the current to the actuators to create a force that dampens oscillations of the system.

Damping other than the hardware setup may be provided by feedback control of the damping enhancement. In one embodiment, in order to do that, derivative of force output, (i.e. jerk) can be estimated using a filter.

Simple difference $$D(z^{-1})=1/T(1-z^{-1})$$

$3^{rd}$ order filter $$D(z^{-1})=1/T(0.3+0.1\ z^{-1}-0.1\ z^{-2}-0.3\ z^{-3})$$

and $7_{th}$ order filter $$D(z^{-1})=1/T(0.0833+0.595\ z^{-1}+0.119z^{-3}-0.0119z^{-4}-0.0357z^{-5}-0.0595z^{-6}-0.0833z^{-7})$$

Higher order estimation has smoother output with the tradeoff of longer time delays.

Figure 8:
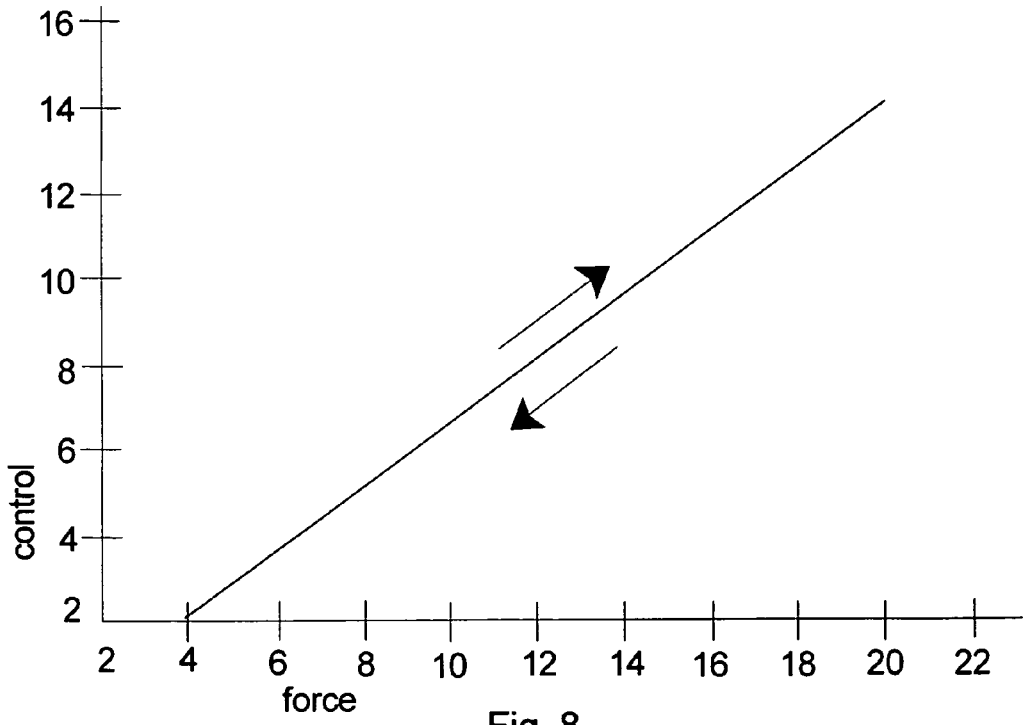
FIG. 8 is a graph that illustrates force versus voltage.

FIG. 8 is a graph that illustrates the relationship between voltage and force for one embodiment of an actuator. In this embodiment, as voltage is increased, force generated by the actuator is also increased.

Figure 9A:
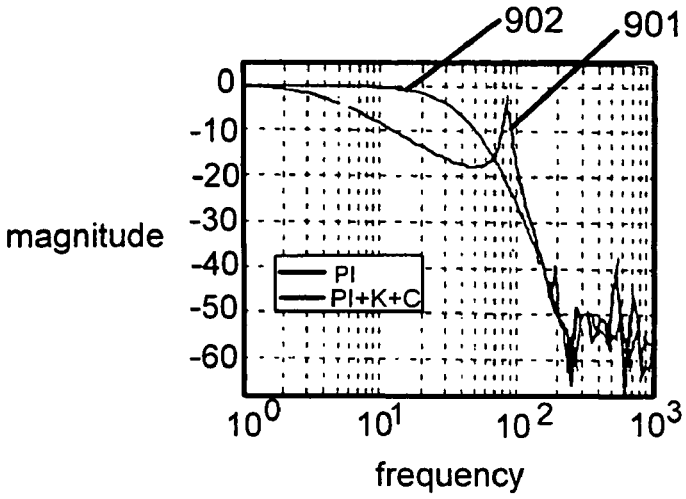
FIGS. 9A–9F are alternative graphs that illustrate features of the present invention.
Figure 9C:
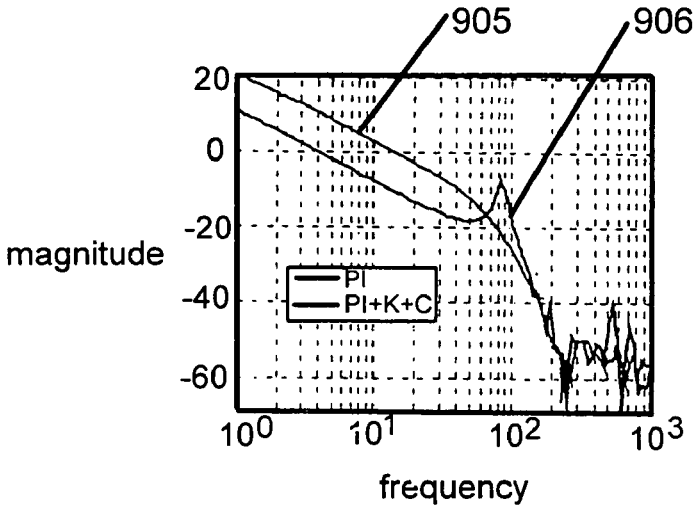
Figure 9E:
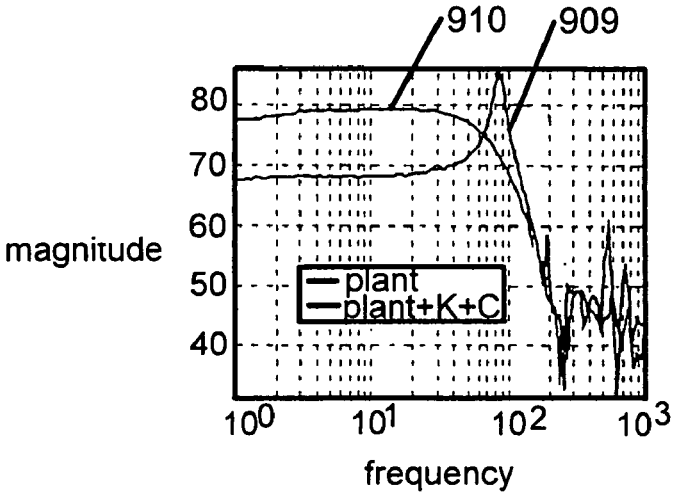
Figure 9B:
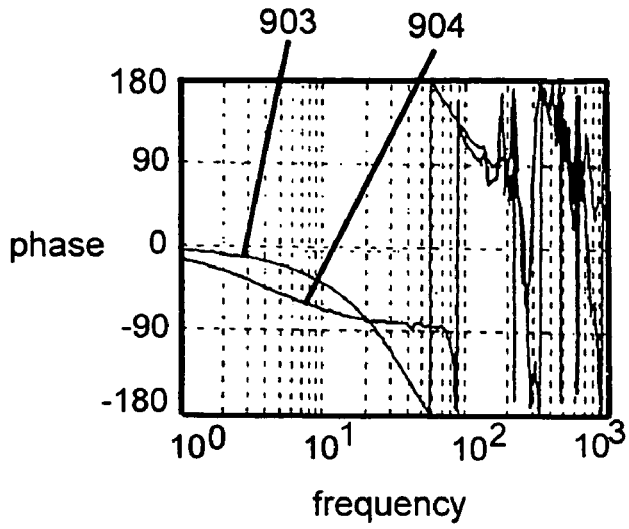

FIGS. 9A and 9B are alternative graphs that illustrate the closed loop frequency response of a system. In FIG. 9A, the graph represents magnitude versus frequency for a system. Line 901 represents the response of the system if the control system does not utilize damping enhancement and stiffness compensation and line 902 represents the response of the system if the control system utilizes damping enhancement and stiffness compensation. In FIG. 9B, the graph represents phase versus frequency for a system. Line 903 represents the response of the system if the control system does not utilize damping enhancement and stiffness compensation and line 904 represents the response of the system if the control system utilizes damping enhancement and stiffness compensation.

Figure 9D:
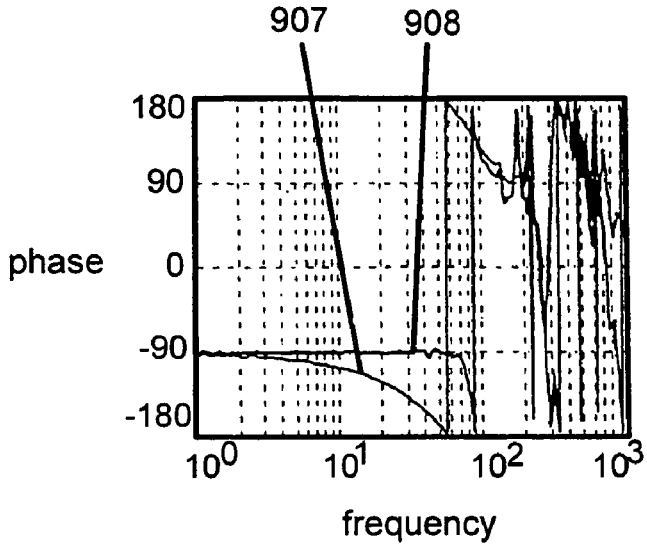

FIGS. 9C and 9D are alternative graphs that illustrate the open loop frequency response of a system. In FIG. 9C, the graph represents magnitude versus frequency for a system. Line 905 represents the response of the system if the control system does not utilize damping enhancement and stiffness compensation and line 906 represents the response of the system if the control system utilizes damping enhancement and stiffness compensation. In FIG. 9D, the graph represents phase versus frequency for a system. Line 907 represents the response of the system if the control system does not utilize damping enhancement and stiffness compensation and line 908 represents the response of the system if the control system utilizes damping enhancement and stiffness compensation.

Figure 9F:
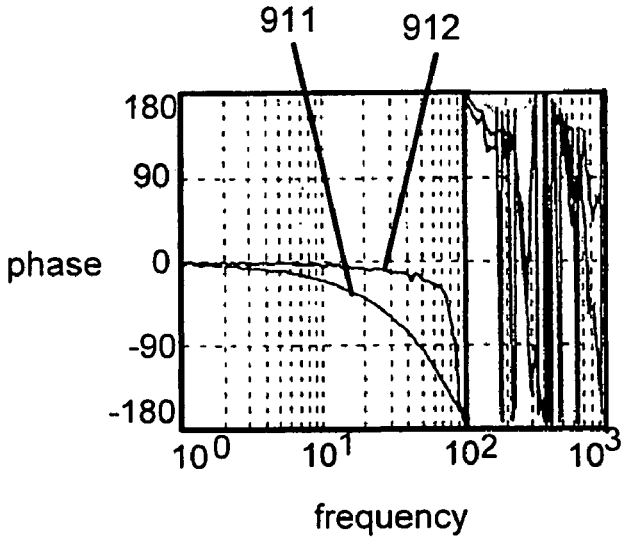

FIGS. 9E and 9F are alternative graphs that illustrate the plant frequency response of a system. In FIG. 9E, the graph represents magnitude versus frequency for a system. Line 909 represents the response of the system if the control system does not utilize damping enhancement and stiffness compensation and line 910 represents the response of the system if the control system utilizes damping enhancement and stiffness compensation. In FIG. 9F, the graph represents phase versus frequency for a system. Line 911 represents the response of the system if the control system does not utilize damping enhancement and stiffness compensation and line 912 represents the response of the system if the control system utilizes damping enhancement and stiffness compensation.

Figure 10A:
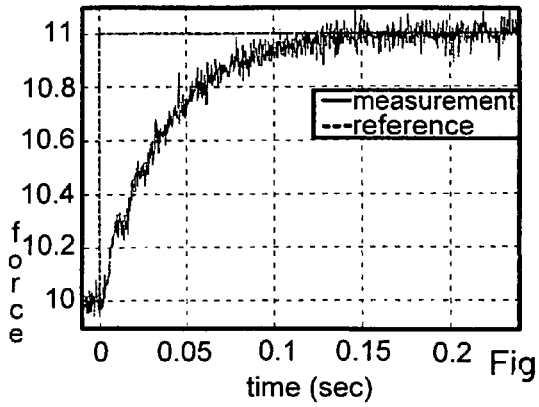
FIGS. 10A–10E are alternative graphs that illustrate features of the present invention.

FIG. 10A is a graph that illustrates the force step response from 10 newtons to 11 newtons for a system if the control system does not utilize damping enhancement and stiffness compensation.

Figure 10B:
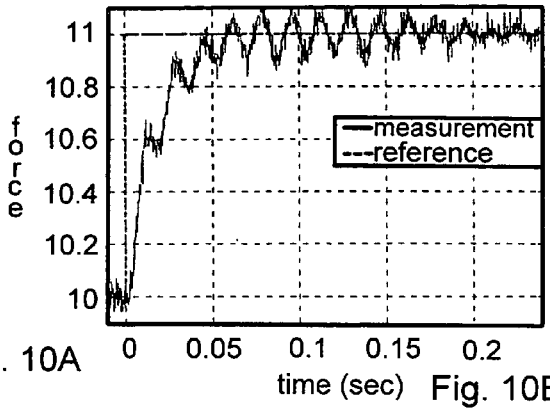

FIG. 10B is a graph that illustrates the force step response from 10 newtons to 11 newtons for a system if the control system that utilizes stiffness compensation.

Figure 10C:
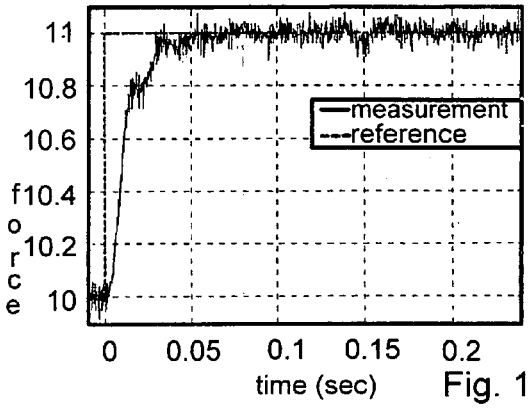

FIG. 10C is a graph that illustrates the force step response from 10 newtons to 11 newtons for a system if the control system that utilizes first order damping enhancement and stiffness compensation.

Figure 10D:
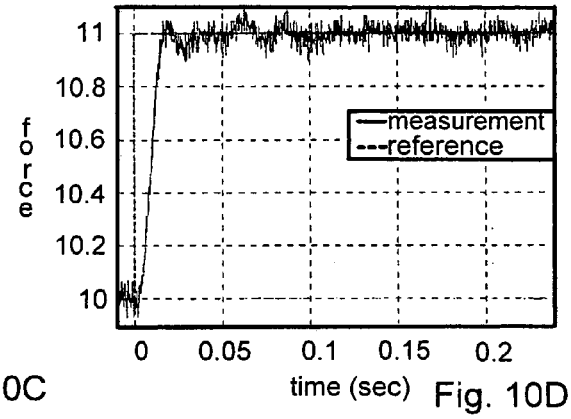

FIG. 10D is a graph that illustrates the force step response from 10 newtons to 11 newtons for a system if the control system that utilizes third order damping enhancement and stiffness compensation.

Figure 10E:
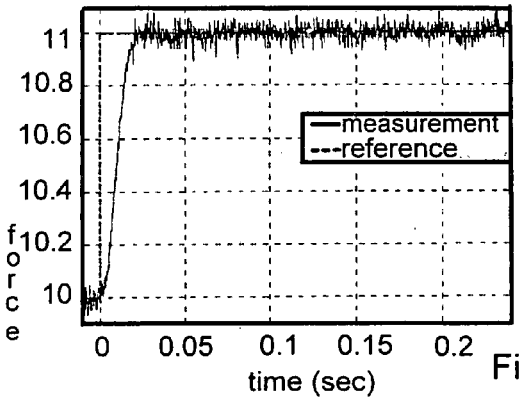

FIG. 10E is a graph that illustrates the force step response from 10 newtons to 11 newtons for a system if the control system that utilizes seventh order damping enhancement and stiffness compensation.

The graphs provided herein illustrate that with stiffness compensation and additional software damping, the system dynamics can be well re-shaped. Hence the resonance due to the mounting can be completely removed.

Figure 11:
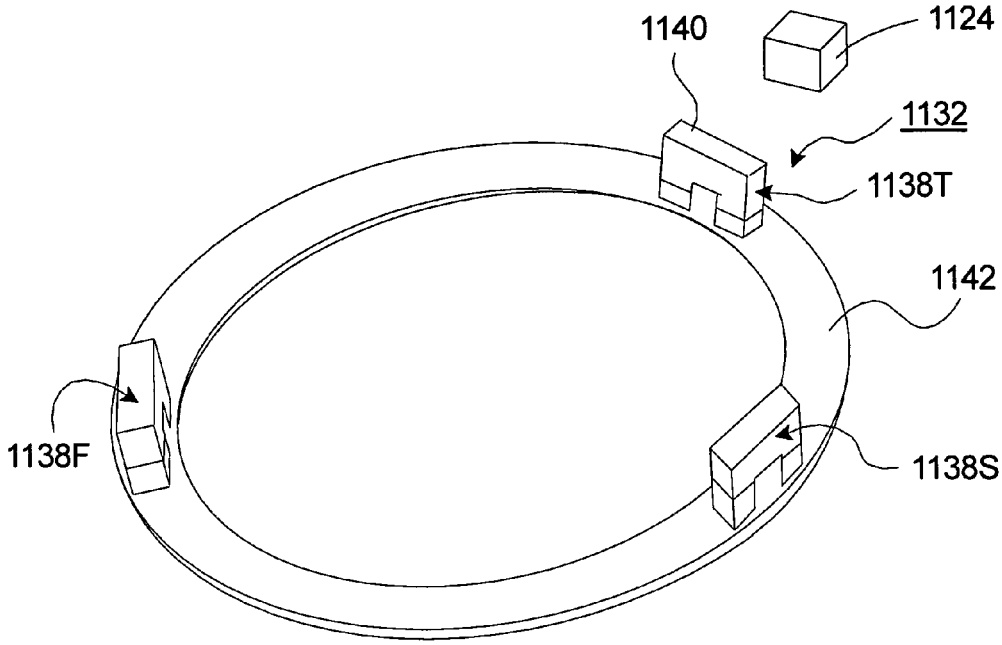
FIG. 11 is a perspective view of another embodiment of a portion of an actuator assembly having features of the present invention.

FIG. 11 illustrates a perspective view of the control system 1124 and yet another embodiment of the actuator assembly 1132 and including three spaced apart first actuator subassemblies 1140 and one second actuator subassembly 1142 that is spaced apart from the first actuator subassemblies 1140 and form three spaced apart actuators 1138F, 1138S, 1138T. Alternatively, for example, the actuator assembly 1132 can include more than three or less than three first actuator subassemblies 1140.

In this embodiment, each of the actuators 1138F, 1138S, 1138T is an attraction only actuator that is somewhat similar to the corresponding components described above and illustrated in FIG. 5A. However, in this embodiment, the first actuator subassemblies 1140 are oriented so that the poles of the C-core 1102 are arranged tangentially to the second actuator subassembly 1142. In certain designs, this allows space for larger coils and cores for higher force and better efficiency.

Figure 12:
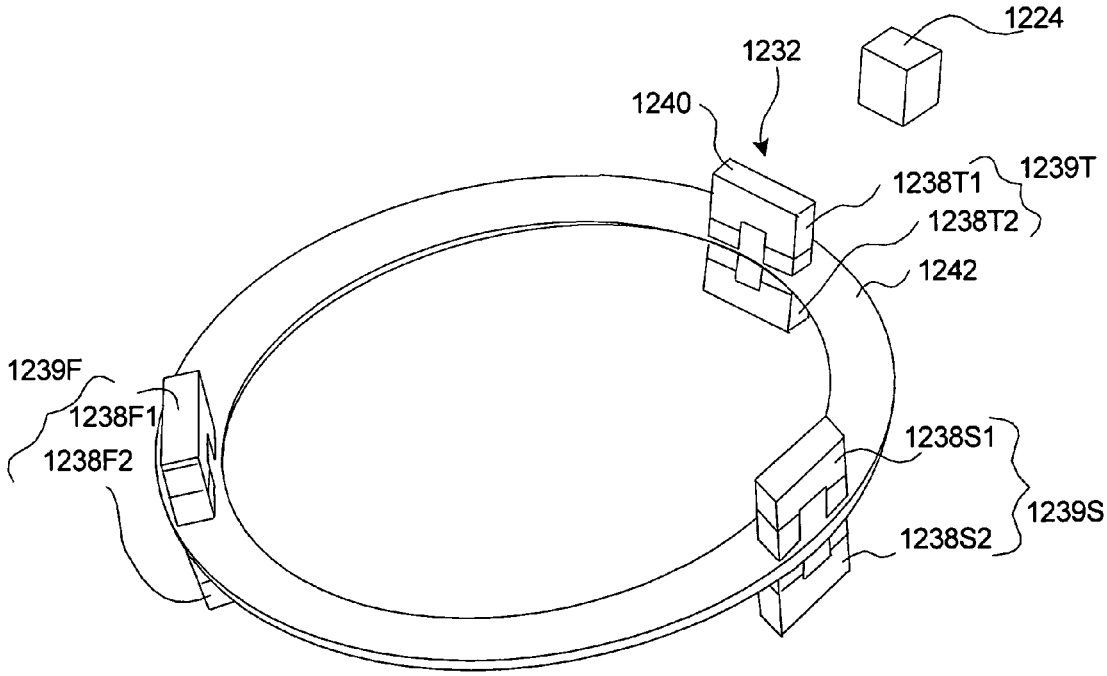
FIG. 12 is a perspective view of still another embodiment of a portion of an actuator assembly having features of the present invention.

FIG. 12 illustrates a perspective view of the control system 1224 and yet another embodiment of the actuator assembly 1232 including six spaced apart first actuator subassemblies 1240 and a common second actuator subassembly 1242 that is spaced apart from the first actuator subassemblies 1240. The first actuator subassemblies 1240 and the second actuator subassembly 1242 cooperate to form six spaced apart actuators 1238F1, 1238F2, 1238S1, 1238S2, 1238T1, 1238T2 that cooperate to form three actuator pairs 1239F, 1239S, 1239T. The first actuator subassemblies 1240 are secured to the first housing 426 (illustrated in FIG. 4B) and the second actuator subassembly 1242 can be secured to the pad holder 50 (illustrated in FIG. 4B).

In this embodiment, each of the actuators 1238F1, 1238F2, 1238S1, 1238S2, 1238T1, 1238T2 of each actuator pair 1238F, 1238S, 1238T is an attraction only actuator that is somewhat similar to the corresponding components described above and illustrated in FIG. 5A. The actuator pairs 1238F, 1238S, 1238T allow the actuator assembly 1232 to increase or decrease the force of the pad against the substrate. With this design, in certain embodiments, the first force adjuster 406 (illustrated in FIG. 4B) may not be necessary.

Figure 13:
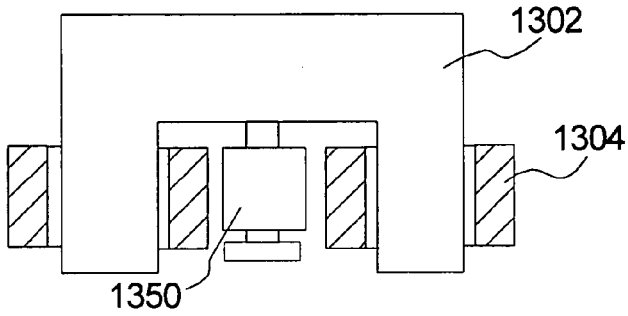
FIG. 13 is a side illustration of another embodiment of an actuator having features of the present invention.

FIG. 13 is simplified cut-away side view of another embodiment of the first core 1302 and conductors 1304. FIG. 13 also illustrates that the sensor 1350 in this embodiment is positioned in the "saddle" of the C shaped first core 1302. With this design, the sensor 1350 is compressed during usage. It should be noted that the sensor 1350 could be located in other positions.

Figure 14:
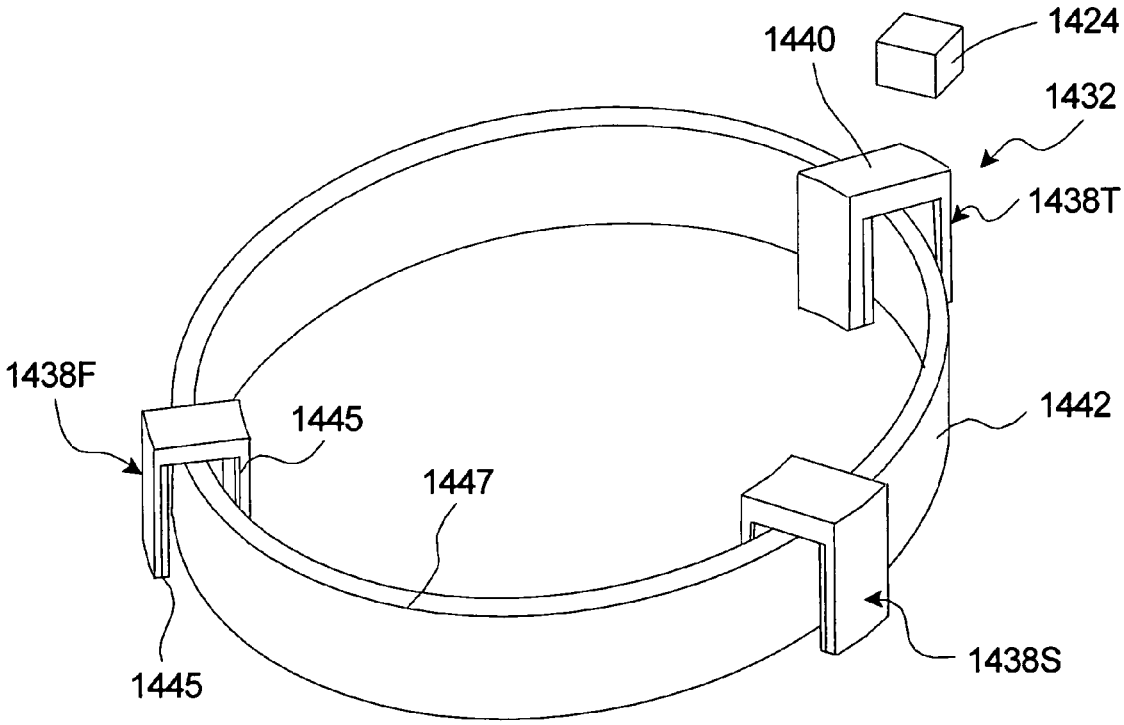
FIG. 14 is a perspective view of yet another embodiment of a portion of an actuator assembly having features of the present invention.

FIG. 14 illustrates a perspective view of the control system 1424 and yet another embodiment of the actuator assembly 1432 including three spaced apart first actuator subassemblies 1440 and a common second actuator subassembly 1442 that is spaced apart from the first actuator subassemblies 1440. The first actuator subassemblies 1440 and the second actuator subassembly 1442 cooperate to form three spaced apart actuators 1438F, 1438S, 1438T. Alternatively, for example, the actuator assembly 1432 can include more than three or less than three first actuator subassemblies 1440. The first actuator subassemblies 1440 can be secured to the first housing 426 (illustrated in FIG. 4B) and the second actuator subassembly 1442 can be secured to the pad holder 50 (illustrated in FIG. 4B).

In this embodiment, each of the actuators 1438F, 1438S, 1438T is a voice coil type actuator. In this embodiment, one of the actuator subassemblies 1440, 1442 includes a magnet array and one of the actuator subassemblies 1440, 1442 includes a conductor array. For example, each of the first actuator subassemblies 1440 can include a conductor 1445 or a pair of spaced apart conductors 1445 and the second actuator subassembly 1442 is an annular ring shaped magnet 1447. With this design, the control system 1424 can direct current to the conductors 1445 to increase or decrease the pressure that the pad exerts on the substrate. With this design, in certain embodiments, the first force adjuster 406 (illustrated in FIG. 4B) may not be necessary.

While the particular apparatus 10 and method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A polishing apparatus for polishing a device with a polishing pad, the polishing apparatus comprising: a pad holder that retains the polishing pad; and an actuator assembly that includes a plurality of spaced apart actuators that are coupled to the pad holder, each of the actuators directing a force on the pad holder that alters the pressure of the polishing pad on the device, wherein at least one of the actuators is an attraction only actuator.

2. The polishing apparatus of claim 1 wherein the attraction only actuator includes a first core that is substantially "C" shaped.

3. The polishing apparatus of claim 1 wherein the attraction only actuator includes a first core that is substantially "E" shaped.

4. The polishing apparatus of claim 1 wherein the attraction only actuator includes a first core, a conductor secured to the first core, and a second core spaced apart a component gap from the first core, the second core being coupled to the pad holder.

5. The polishing apparatus of claim 4 further comprising a control system that directs current to the conductor to attract the second core to the first core, wherein the amount of current directed to the conductor is calculated without measuring the component gap.

6. The polishing apparatus of claim 1 further comprising a fluid source that controls the pressure in a chamber to direct a force on the pad holder to alter the pressure of the polishing pad on the device.

7. A method for making a device that includes the steps of providing a substrate and polishing the substrate with the polishing apparatus according to claim 1.

8. A method for making a wafer that includes the steps of providing a substrate and polishing the substrate with the polishing apparatus according to claim 1.

9. The polishing apparatus of claim 1 wherein the plurality of spaced apart actuators dynamically control the force applied at various positions of the pad holder to inhibit over-polishing at an edge of the device.

10. The polishing apparatus of claim 1 wherein the plurality of space apart actuators dynamically control the force applied at various positions of the pad holder to achieve substantially uniform polishing of the device.

11. A polishing apparatus for polishing a device with a polishing pad, the polishing apparatus comprising: a pad holder that retains the polishing pad; and an actuator assembly that includes a plurality of spaced apart actuators that are coupled to the pad holder, each of the actuators directing a force on the pad holder that alters the pressure of the polishing pad on the device, wherein at least one of the actuators includes a first actuator subassembly and a second actuator subassembly that interacts with the first actuator subassembly to direct a force on the pad holder, the second actuator subassembly being coupled to the pad holder.

12. The polishing apparatus of claim 11 wherein at least one of the actuators is a voice coil type actuator.

13. The polishing apparatus of claim 11 further comprising a pad rotator that rotates the pad holder and the second actuator subassembly relative to the first actuator subassembly.

14. A polishing apparatus for polishing a device with a polishing pad, the polishing apparatus comprising: a pad holder that retains the polishing pad; and an actuator assembly that includes a plurality of spaced apart actuators that are coupled to the pad holder, each of the actuators directing a force on the pad holder that alters the pressure of the polishing pad on the device; wherein the plurality of spaced apart actuators dynamically control the force applied at various positions of the pad holder to inhibit over-polishing at an edge of the device; and wherein the plurality of spaced apart actuators dynamically control the force applied at various positions of the pad holder to inhibit tilting of the pad when only a portion of the pad is adjacent to the device.

15. A polishing apparatus for polishing a device with a polishing pad, the polishing apparatus comprising:

a pad holder that retains the polishing pad; and an actuator assembly that includes an attraction only actuator that is coupled to the pad holder, the attraction only actuator directing a force on the pad holder to alter the pressure of the polishing pad on the device.

16. The polishing apparatus of claim 15 wherein the actuator assembly includes three spaced apart attraction only actuators.

17. The polishing apparatus of claim 15 wherein the attraction only actuator includes a first core that is substantially "C" shaped.

18. The polishing apparatus of claim 15 wherein the attraction only actuator includes a first core that is substantially "E" shaped.

19. The polishing apparatus of claim 15 wherein the attraction only actuator includes a first actuator subassembly and a second actuator subassembly that interacts with the first actuator subassembly to direct the force on the pad holder, the second actuator subassembly being coupled to the pad holder.

20. The polishing apparatus of claim 19 further comprising a pad rotator that rotates the pad holder and the second actuator subassembly relative to the first actuator subassembly.

21. The polishing apparatus of claim 15 further comprising a fluid source that controls the pressure in a chamber to alter the pressure of the polishing pad on the device.

22. A method for making a wafer that includes the steps of providing a substrate and polishing the substrate with the polishing apparatus according to claim 15.

23. The polishing apparatus of claim 15 wherein the actuator assembly dynamically controls the force applied at various positions of the pad to inhibit over-polishing at an edge of the device.

24. The polishing apparatus of claim 15 wherein the actuator assembly dynamically controls the force applied at various positions of the pad to inhibit tilting of the pad when only a portion of the pad is adjacent to the device.

25. The polishing apparatus of claim 15 wherein the actuator assembly dynamically controls the force applied at various positions of the pad to achieve substantially uniform polishing of the device.

26. A polishing apparatus for polishing a device, the polishing apparatus comprising:

a pad holder that retains a polishing pad;

an actuator assembly that includes an attraction only actuator having a first actuator subassembly and a second actuator subassembly, the second actuator subassembly being coupled to the pad holder, the second actuator subassembly interacting with the first actuator subassembly to direct a force on the pad holder relative to the device to alter the pressure of the polishing pad on the device; and a pad rotator that rotates the pad and the second actuator subassembly relative to first actuator subassembly.

27. The polishing apparatus of claim 26 wherein the actuator assembly tilts the pad holder without substantially distorting the pad holder.

28. The polishing apparatus of claim 26 wherein the actuator assembly includes three spaced apart actuators.

29. The polishing apparatus of claim 26 further comprising a fluid source that controls the pressure in a chamber to alter the pressure of the polishing pad on the device.

30. A method for making a wafer that includes the steps of providing a substrate and polishing the substrate with the polishing apparatus according to claim 26.

31. The polishing apparatus of claim 26 wherein the actuator assembly dynamically controls the force applied at various positions of the pad to inhibit over-polishing at an edge of the device.

32. The polishing apparatus of claim 26 wherein the actuator assembly dynamically controls the force applied at various positions of the pad to inhibit tilting of the pad when only a portion of the pad is adjacent to the device.

33. The polishing apparatus of claim 26 wherein the actuator assembly dynamically controls the force applied at various positions of the pad to achieve substantially uniform polishing of the device.

34. A method for polishing a device, the method comprising the steps of: retaining a polishing pad with a pad holder; and directing a force on the pad holder to alter the pressure of the polishing pad on the device with an actuator assembly, the actuator assembly including a plurality of spaced apart actuators that are coupled to the pad holder, wherein at least one of the actuators is an attraction only actuator.

35. The method of claim 34 further comprising the step of controlling the pressure in a chamber with a fluid source to alter the pressure of the polishing pad on the device.

36. A method for making a device that includes the steps of providing a substrate and polishing the substrate by the method of claim 34.

37. A method for polishing a device, the method comprising the steps of: retaining a polishing pad with a pad holder; and directing a force on the pad holder to alter the pressure of the polishing pad on the device with an actuator assembly, the actuator assembly including a plurality of spaced apart actuators that are coupled to the pad holder, wherein at least one of the actuators includes a first actuator subassembly and a second actuator subassembly that interacts with the first actuator subassembly to direct the force on the pad holder, the second actuator subassembly being coupled to the pad holder.

38. The method of claim 37 wherein at least one of the actuators is a voice coil type actuator.

39. The method of claim 37 further comprising the step of rotating the pad holder and the second actuator subassembly relative to the first actuator subassembly with a pad rotator.

40. A method for polishing a device, the method comprising the steps of:

providing a pad holder that retains a polishing pad;

directing a force on the pad holder to alter the pressure of the polishing pad on the device with an actuator assembly, the actuator assembly including a plurality of spaced apart actuators each having a first actuator subassembly and a second actuator subassembly, the second actuator subassembly being coupled to the pad holder, the second actuator subassembly interacting with the first actuator subassembly to alter the pressure of the polishing pad on the device; and rotating the polishing pad and the second actuator subassembly relative to first actuator subassembly with a pad rotator.

41. The method of claim 40 wherein at least one of the actuators is an attraction only actuator.

42. The method of claim 40 wherein at least one of the actuators is a voice coil type actuator.

43. The method of claim 40 further comprising the step of controlling the pressure in a chamber with a fluid source to alter the pressure of the polishing pad on the device.

44. A method for making a device that includes the steps of providing a substrate and polishing the substrate by the method of claim 40.

45. A polishing apparatus for polishing a device, the polishing apparatus comprising:

a pad holder that retains a polishing pad;

an actuator assembly that includes an actuator having a first actuator subassembly and a second actuator subassembly, the second actuator subassembly being coupled to the pad holder, the second actuator subassembly interacting with the first actuator subassembly to direct a force on the pad holder relative to the device to alter the pressure of the polishing pad on the device, wherein the actuator assembly tilts the pad holder without substantially distorting the pad holder; and a pad rotator that rotates the pad and the second actuator subassembly relative to first actuator subassembly.

46. A polishing apparatus for polishing a device, the polishing apparatus comprising:

a pad holder that retains a polishing pad;

an actuator assembly that includes a voice coil type actuator having a first actuator subassembly and a second actuator subassembly, the second actuator subassembly being coupled to the pad holder, the second actuator subassembly interacting with the first actuator subassembly to direct a force on the pad holder relative to the device to alter the pressure of the polishing pad on the device; and a pad rotator that rotates the pad and the second actuator subassembly relative to first actuator subassembly.

* * * * *